US010988987B2

(12) United States Patent
Wheeler et al.

(10) Patent No.: US 10,988,987 B2
(45) Date of Patent: Apr. 27, 2021

(54) STEERING ASSEMBLY CONTROL VALVE

(71) Applicant: Halliburton Energy Services, Inc., Houston, TX (US)

(72) Inventors: Fraser Wheeler, Edmonton (CA); Wei Zhang, Taiwan (CN); Richard T. Hay, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/620,409

(22) PCT Filed: Jul. 11, 2017

(86) PCT No.: PCT/US2017/041524
§ 371 (c)(1),
(2) Date: Dec. 6, 2019

(87) PCT Pub. No.: WO2019/013766
PCT Pub. Date: Jan. 17, 2019

(65) Prior Publication Data

US 2021/0079729 A1 Mar. 18, 2021

(51) Int. Cl.
*E21B 7/06* (2006.01)
*E21B 17/10* (2006.01)
(Continued)

(52) U.S. Cl.
CPC ..... *E21B 7/065* (2013.01); *E21B 7/068* (2013.01); *E21B 17/1014* (2013.01); *E21B 21/10* (2013.01); *E21B 34/066* (2013.01)

(58) Field of Classification Search
CPC ..... E21B 7/065; E21B 7/068; E21B 21/10; E21B 17/1014; E21B 34/066; E21B 7/06; E21B 23/12; E21B 34/06
See application file for complete search history.

(56) References Cited

U.S. PATENT DOCUMENTS 4,394,881 A * 7/1983 Shirley ..... E21B 7/062 175/76
2009/0086576 A1 4/2009 Downton et al.
(Continued)

FOREIGN PATENT DOCUMENTS

WO 1999028587 6/1999
WO 2017116448 7/2017

OTHER PUBLICATIONS

ISRWO International Search Report and Written Opinion for PCT/US2017/041524 dated Apr. 10, 2018.

*Primary Examiner* — Tara Schimpf
*Assistant Examiner* — Manuel C Portocarrero
(74) *Attorney, Agent, or Firm* — Benjamin Ford; C. Tumey Law Group PLLC

(57) ABSTRACT

Control valves can allow for a steering assembly of a drill string. An exemplary control valve can include a first valve element including a first orifice, the first valve element being movable by actuation by a motor, and a second valve element including an orifice, wherein flow passing through the first valve element orifice passes through the second orifice and into a flow channel to be in fluid communication with a piston bore to exert pressure against a piston movable within the piston bore, the piston being coupled to a steering pad for applying force against the wellbore wall to steer a direction of the drill string. The first valve element is movable with respect to the second valve element to change flow through the first valve element orifice and the second valve element orifice to modify fluid pressure within the flow channel that is exerted against the piston.

20 Claims, 25 Drawing Sheets

(51) Int. Cl.
*E21B 21/10* (2006.01)
*E21B 34/06* (2006.01)

(56) References Cited

U.S. PATENT DOCUMENTS

| | | | | |
|---|---|---|---|---|
| 2010/0089583 | A1* | 4/2010 | Xu | E21B 7/28 166/298 |
| 2011/0056695 | A1 | 3/2011 | Downton | |
| 2012/0160565 | A1 | 6/2012 | Downton et al. | |
| 2013/0160736 | A1* | 6/2013 | Matsuzaki | F02D 9/1095 123/337 |

* cited by examiner

STEERING ASSEMBLY CONTROL VALVE

TECHNICAL FIELD

The present description relates in general to wellbore drilling and more particularly to, for example, without limitation, to directional control of a rotary steerable drilling assembly using a control valve.

BACKGROUND OF THE DISCLOSURE

In the oil and gas industry, wellbores are commonly drilled to intercept and penetrate particular subterranean formations to enable the efficient extraction of embedded hydrocarbons. To reach desired subterranean formations, it is often required to undertake directional drilling, which entails dynamically controlling the direction of drilling, rather than simply drilling a nominally vertical wellbore path. Directionally-drilled wellbores can include portions that are vertical, curved, horizontal, and portions that generally extend laterally at any angle from the vertical wellbore portions.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Accordingly, the drawings and description are to be regarded as illustrative in nature and not restrictive.

The present disclosure is related to wellbore drilling and, more specifically, to directional control of a rotary steerable drilling assembly using a control valve.

A directional drilling technique can involve the use of a rotary steerable drilling system that controls an azimuthal direction and/or degree of deflection while the entire drill string is rotated continuously. Rotary steerable drilling systems typically involve the use of an actuation mechanism that helps the drill bit deviate from the current path using either a "point the bit" or "push the bit" mechanism. In a "point the bit" system, the actuation mechanism deflects and orients the drill bit to a desired position by bending the drill bit drive shaft within the body of the rotary steerable assembly. As a result, the drill bit tilts and deviates with respect to the wellbore axis. In a "push the bit" system, the actuation mechanism is used to instead push the drill string against the wall of the wellbore, thereby offsetting the drill bit with respect to the wellbore axis. While drilling a straight section, the actuation mechanism remains disengaged so that there is generally no pushing against the formation. As a result, the drill string proceeds generally concentric to the wellbore axis. Yet another directional drilling technique, generally referred to as the "push to point," encompasses a combination of the "point the bit" and "push the bit" methods. Rotary steerable systems may utilize a plurality of steering pads that can be actuated in a lateral direction to control the direction of drilling, and the steering pads may be controlled by a variety of valves and control systems.

According to at least some embodiments disclosed herein is the realization that the control valve disclosed herein can allow for advanced control of pads of a steering assembly. Further, according to at least some embodiments disclosed herein is the realization that the control valve disclosed herein can allow for minimized pad wear.

Figure 1A:
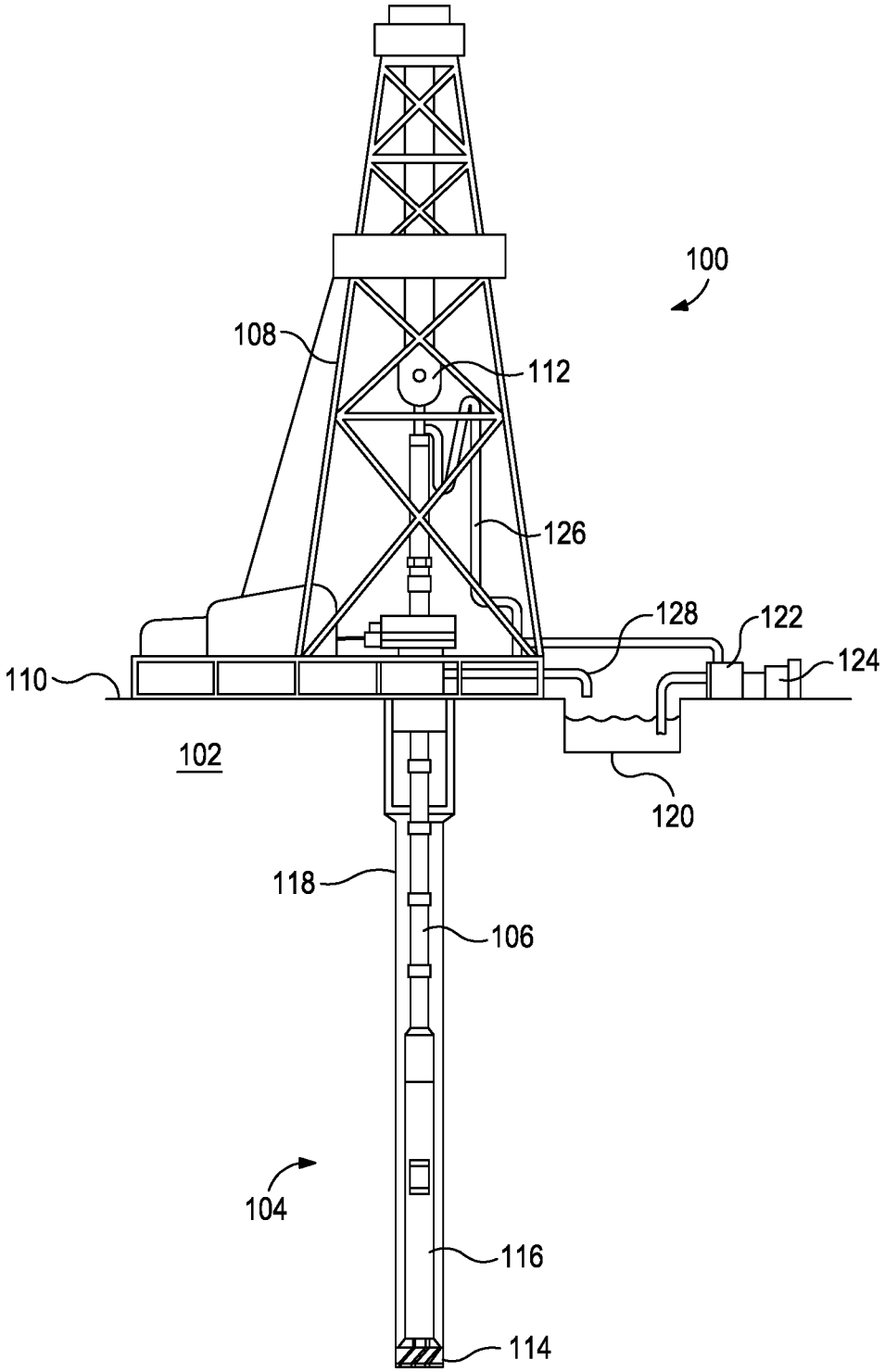
FIG. 1A is an elevation view of a drilling system, according to some embodiments of the present disclosure.

FIG. 1A is an elevation view of an exemplary drilling system 100 that may employ one or more principles of the present disclosure. Wellbores may be created by drilling into the earth 102 using the drilling system 100. The drilling system 100 may be configured to drive a bottom hole assembly (BHA) 104 positioned or otherwise arranged at the bottom of a drill string 106 extended into the earth 102 from a derrick or rig 108 arranged at the surface 110. The derrick 108 includes a traveling block 112 used to lower and raise the drill string 106.

The BHA 104 may include a drill bit 114 operatively coupled to a tool string 116 which may be moved axially within a drilled wellbore 118 as attached to the drill string 106. During operation, the drill bit 114 penetrates the earth 102 and thereby creates the wellbore 118. The BHA 104 provides directional control of the drill bit 114 as it advances into the earth 102. The tool string 116 can be semi-permanently mounted with various measurement tools (not shown) such as, but not limited to, measurement-while-drilling (MWD) and logging-while-drilling (LWD) tools, that may be configured to take downhole measurements of drilling conditions. In other embodiments, the measurement tools may be self-contained within the tool string 116, as shown in FIG. 1A.

Drilling fluid ("mud") from a mud tank 120 may be pumped downhole using a mud pump 122 powered by an adjacent power source, such as a prime mover or motor. The mud may be pumped from the mud tank 120, through a standpipe 126, which feeds the mud into the drill string 106 and conveys the same to the drill bit 114. The mud exits one or more nozzles arranged in the drill bit 114 and in the process cools the drill bit 114. After exiting the drill bit 114, the mud circulates back to the surface 110 via the annulus defined between the wellbore 118 and the drill string 106, and in the process, returns drill cuttings and debris to the surface. The cuttings and mud mixture are passed through a flow line 128 and are processed such that a cleaned mud is returned down hole through the standpipe 126 once again.

Although the drilling system 100 is shown and described with respect to a rotary drill system in FIG. 1A, those skilled in the art will readily appreciate that many types of drilling systems can be employed in carrying out embodiments of the disclosure. For example, drills and drill rigs used in embodiments of the disclosure may be used onshore (as depicted in FIG. 1A) or offshore (not shown). Offshore oilrigs that may be used in accordance with embodiments of the disclosure include, for example, floaters, fixed platforms, gravity-based structures, drill ships, semi-submersible platforms, jack-up drilling rigs, tension-leg platforms, and the like. It will be appreciated that embodiments of the disclosure can be applied to rigs ranging anywhere from small in size and portable, to bulky and permanent.

Further, although described herein with respect to oil drilling, various embodiments of the disclosure may be used in many other applications. For example, disclosed methods can be used in drilling for mineral exploration, environmental investigation, natural gas extraction, underground installation, mining operations, water wells, geothermal wells, and the like. Further, embodiments of the disclosure may be used in weight-on-packers assemblies, in running liner hangers, in running completion strings, etc., without departing from the scope of the disclosure.

While not specifically illustrated, those skilled in the art will readily appreciate that the BHA 104 may further include various other types of drilling tools or components such as, but not limited to, a steering unit, one or more stabilizers, one or more mechanics and dynamics tools, one or more drill collars, one or more accelerometers, one or more magnetometers, and one or more jars, and one or more heavy weight drill pipe segments.

Embodiments of the present disclosure may be applicable to horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as wellbore construction for river crossing tunneling and other such tunneling wellbores for near surface construction purposes or wellbore u-tube pipelines used for the transportation of fluids such as hydrocarbons.

Figure 1B:
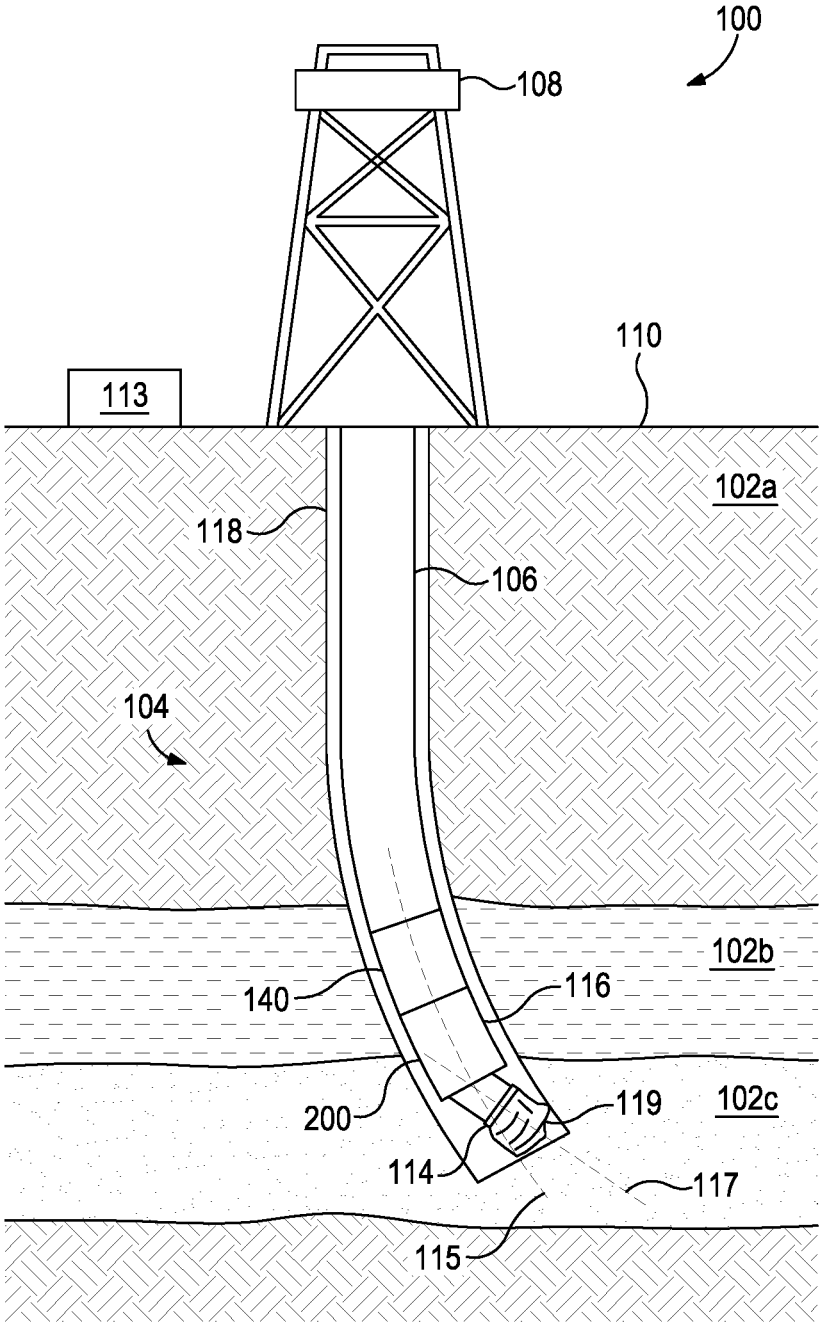
FIG. 1B is an elevation view of a drilling system, according to some embodiments of the present disclosure.

FIG. 1B is an elevation view of an exemplary drilling system 100 that may employ one or more principles of the present disclosure. Referring now to FIG. 1B, illustrated is an exemplary bottom hole assembly (BHA) 104 of an exemplary drilling system 100 that can be used in accordance with one or more embodiments of the present disclosure. The drilling system 100 includes the derrick 108 mounted at the surface 110 and positioned above the wellbore 118 that extends within first, second, and third subterranean formations 102*a*, 102*b*, and 102*c* of the earth 102. In the embodiment shown, a drilling system 100 may be positioned within the wellbore 118 and may be coupled to the derrick 108. The BHA 104 may include a drill bit 114, a measurement-while-drilling (MWD) apparatus 140 and a steering assembly 200. The steering assembly 200 may control the direction in which the wellbore 118 is being drilled. As will be appreciated by one of ordinary skill in the art in view of this disclosure, the wellbore 118 can be drilled in the direction perpendicular to the tool face 119 of the drill bit 114, which corresponds to the longitudinal axis 117 of the drill bit 114. Accordingly, controlling the direction of the wellbore 118 may include controlling the angle between the longitudinal axis 117 of the drill bit 114 and longitudinal axis 115 of the steering assembly 200, and controlling the angular orientation of the drill bit 114 relative to the earth 102.

According to one or more embodiments, the steering assembly 200 may include an offset mandrel (not shown in FIG. 1B) that causes the longitudinal axis 117 of the drill bit 114 to deviate from the longitudinal axis 115 of the steering assembly 200. The offset mandrel may be counter-rotated relative to the rotation of the drill string 106 to maintain an angular orientation of the drill bit 114 relative to the earth 102.

According to one or more embodiments, the steering assembly 200 may receive control signals from a control unit 113. According to one or more embodiments, as shown in FIG. 1B, the control unit 113 can be located at a surface 110 and placed in communication with operating components of the BHA 104. Alternatively or in combination, the control unit 113 can be located within or along a section of the BHA 104. The control unit 113 may include an information handling system with a processor and a memory device, and may communicate with the steering assembly 200 via a telemetry system. According to one or more embodiments, as will be described below, the control unit 113 may transmit control signals to the steering assembly 200 to alter the longitudinal axis 115 of the drill bit 114 as well as to control counter-rotation of portions of the offset mandrel to maintain the angular orientation of the drill bit 114 relative to the earth 102. As used herein, maintaining the angular orientation of a drill bit relative to the earth 102 may be referred to as maintaining the drill bit in a "geo-stationary" position. According to one or more embodiments, a processor and memory device may be located within the steering assembly 200 to perform some or all of the control functions. Moreover, other BHA 104 components, including the MWD apparatus 140, may communicate with and receive instructions from control unit 113.

According to one or more embodiments, the drill string 106 may be rotated to drill the wellbore 118. The rotation of the drill string 106 may in turn rotate the BHA 104 and the drill bit 114 with the same rotational direction and speed. The rotation may cause the steering assembly 200 to rotate about its longitudinal axis 115, and the drill bit 114 to rotate around its longitudinal axis 117 and the longitudinal axis 115 of the steering assembly 200. The rotation of the drill bit 114 about its longitudinal axis 117 may be desired to cause the drill bit 114 to cut into the formation. The rotation of the drill bit 114 about the longitudinal axis 115 of the steering assembly 200 may be undesired in certain instances, as it changes the angular orientation of the drill bit 114 relative to the earth 102. For example, when the longitudinal axis 117 of the drill bit 114 is at an angle from the longitudinal axis of the drill string 115, as it is in FIG. 1B, the drill bit 114 may rotate about the longitudinal axis 115 of the steering assembly 200, preventing the drilling assembly from drilling at a particular angle and direction to the tool face.

Figure 2:
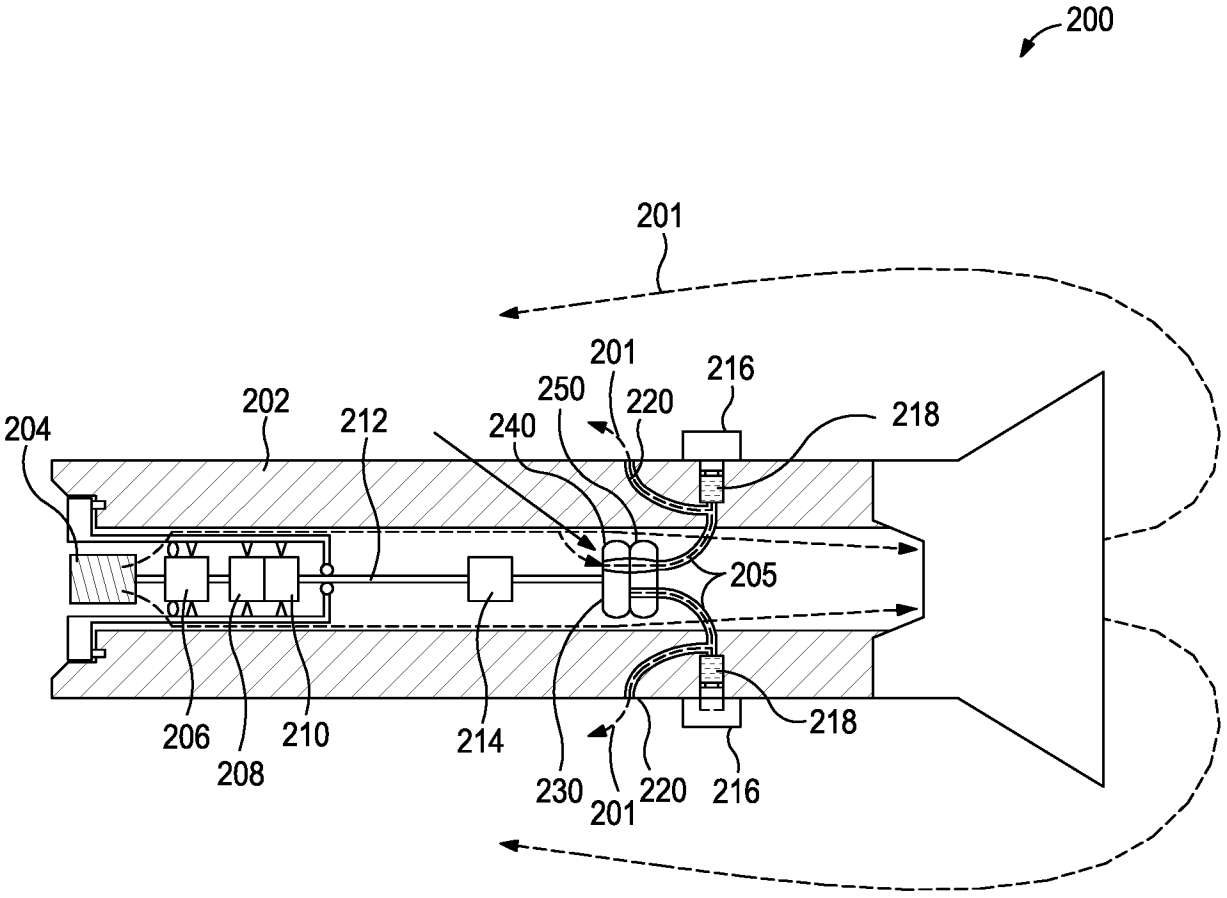
FIG. 2 is a sectional view of a steering assembly, according to some embodiments of the present disclosure.

FIG. 2 is a schematic diagram of an exemplary steering assembly 200 that can employ one or more principles of the present disclosure. In the depicted example, the steering assembly 200 includes a steering assembly body 202 and a control system for directing a drilling fluid flow 201 for actuating one or more steering actuators, such as pistons. The control system can include a powered turbine 204, a generator 206, the controller 208, a motor 210, and a control valve 230. The control system utilizes the control valve 230 to direct drilling fluid flow 201 to exert pressure against the pistons 218 in order to urge the pads 216, thereby steering the drill string and the drill bit 114 in a desired direction or azimuthal orientation.

The steering assembly body 202 can be a generally tubular body, which can receive a drilling fluid flow 201. The drilling fluid flow 201 can pass through the steering assembly body 202 to be received by the drill bit 114. The drilling fluid flow 201 can circulate through the drill bit 114 and flow into an annulus between the drill string and the wellbore being drilled. The steering assembly 200 includes one or more pads 216. The pads 216 are urged to contact the formation to push the drill string against the wellbore wall. The steering assembly 200 can include any suitable number of pads 216 to deflect the steering assembly. In certain embodiments, the steering assembly 200 includes three pads 216. The pads 216 can be controlled by the control valve 230, the controller 208, and the motor 210 to determine a direction of the drill string.

For example, in the depicted example, each pad 216 corresponds to and is coupled to a respective piston 218. The steering assembly 200 includes tubing or flow channels 205 to direct drilling fluid to the steering actuators to exert pressure against the pistons 218, thereby extending the pads 216 radially or laterally relative to steering assembly body 202 and into contact with the pads 216. Thus, each piston 218 can be actuated via drilling fluid flow 201.

As described herein, the fluid flow to each piston 218 is controlled via the control valve 230. In addition to the flow channels 205, the assembly 200 can include piston bores in which the respective pistons 218 reciprocate. The drilling fluid is directed by the steering assembly 200, via the control valve 230, through the flow channels 205 and into one or more piston bores to drive the pistons 218 axially relative to and away from the longitudinal axis of the assembly 200, which in turn radially extends the pads 218 outwardly relative to the longitudinal axis.

Further, after the fluid flow 201 passes through the control valve 230 and into the flow channels 205 to exert pressure against and actuate the pistons 218, the fluid can be bled off from the control system. Fluid passing through the flow channels 205 can also move toward a fluid exhaust port 220 to be discharged from the assembly 200. The fluid exhaust ports 220 can be formed in the steering assembly body 202 and in fluid communication with the flow channels 205 to allow drilling fluid flowing through the flow channels 205 to exit the assembly 200. The fluid exhaust ports 220 can allow for pressure to be relieved from the flow channels 205 and, when the control valve 230 permits less flow or obstructs flow toward a given piston 218, the fluid exhaust port 220 associated with the flow channels 205 will permit pressure in the flow channels 205 to be relieved, thereby permitting the given piston 218 and the respective pad 216 to retract toward the longitudinal axis from an extended position. The size of the fluid exhaust ports 220 can be selected to provide a desired pad retraction speed. In certain embodiments, the fluid exhaust ports 220 can include a fluid restriction, such as a choke, to limit the fluid exhaust flow and control the retraction of the piston 218 and the respective pad 216.

Within the steering assembly body 202, the turbine 204 can receive the drilling fluid flow 201 to rotate the blades of the turbine 204. The turbine 204 is coupled to the generator 206. The rotation of the generator 206 via the turbine 204 can generate electricity for use by the controller 208 and the motor 210.

The motor 210 can be an electric motor that receives generated power from the generator 206. In other embodiments, the motor 210 can be any suitable motor for rotating the control valve 230. In the depicted example, the motor 210 rotates the control valve 230 via the output shaft 212. Rotation of the output shaft 212 rotates the control valve 230 to direct the drilling fluid flow 201 as described herein.

Operation of the motor 210, and therefore the control valve 230, can be controlled by the controller 208. The controller 208 can control the rotational position, speed, and acceleration of the control valve 230 to allow for a desired steering response from the steering assembly 200. The controller 208 can relate a desired steering adjustment with a desired pad 216 actuation. The controller 208 can further relate desired pad 216 actuation with the position of the control valve 230. The controller 208 can be programmed to steer the steering assembly 200 and the drill string along a desired well plan by altering the rotational position, speed, and acceleration of the control valve 230. The controller 208 can utilize feedback mechanisms to adjust the steering of the drill string.

In certain embodiments, a standoff controller 214 can be coupled to the output shaft 212. The standoff controller 214 can axially translate the output shaft 212 within the bore of the steering assembly body 202. The axial translation of the output shaft 212 via the standoff controller 214 can be controlled by the controller 208 in accordance with a desired control scheme. In certain embodiments, the standoff controller 214 can be a hydraulic coupling to adjust the axial position of the output shaft 212 and accordingly components of the control valve 230. The standoff controller 214 can utilize a splined mechanism.

Figure 3:
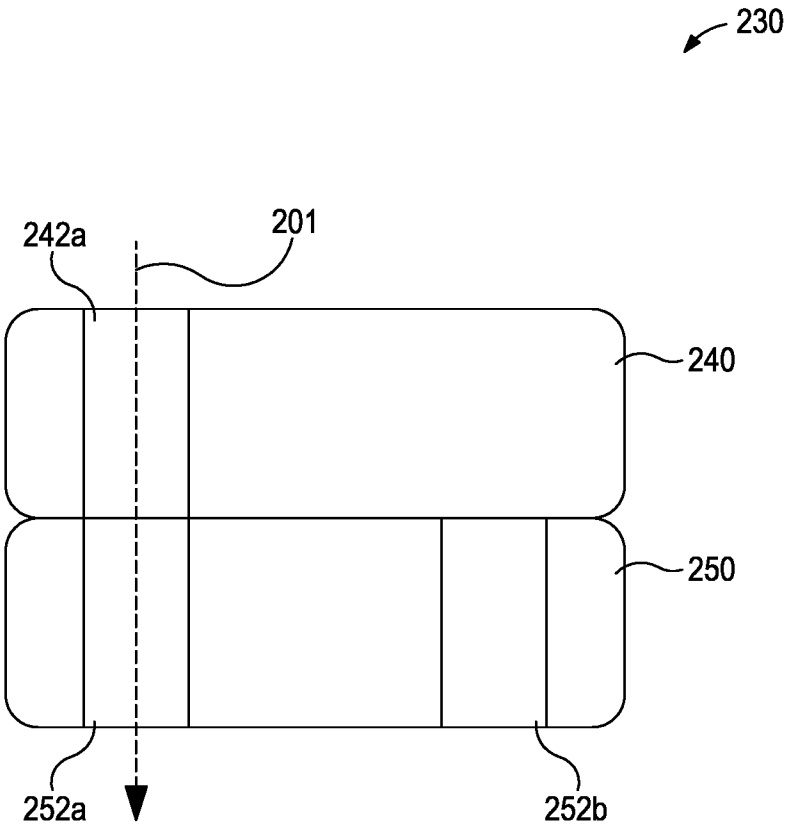
FIG. 3 is a sectional view of a control valve, according to some embodiments of the present disclosure.

FIG. 3 is a sectional view of a control valve 230 according to some embodiments of the present disclosure. The control valve 230 can receive drilling fluid flow 201 and direct the drilling fluid flow 201 to at least one piston 218. In the depicted example, the control valve 230 includes an uphole valve element 240 and a downhole valve element 250. The uphole valve element 240 can move relative to the downhole valve element 250 to allow flow between an upper orifice 242*a* and lower orifices 252.

The uphole valve element 240 can be coupled to the output shaft 212. In certain embodiments, the uphole valve element 240 is coupled to the motor 210 to rotate relative to the downhole valve element 250. Alternatively or in addition, in certain embodiments, the uphole valve element 240 can be translatable via the standoff controller 214 to translate axially relative to the downhole valve element 250. Thus, in certain embodiments, the uphole valve element 240 can be rotatable and/or translatable or otherwise movable relative to the downhole valve element 250 to increase or decrease the drilling fluid flow 201 to at least one piston 218. Finally, in certain embodiments, the uphole valve element 240 can be both rotatable and translatable relative to the downhole valve element 250.

In the depicted example, the uphole valve element 240 includes at least one orifice 242*a*. The orifice 242*a* can allow the drilling fluid flow 201 from an uphole location to pass therethrough. The drilling fluid flow 201 can be directed by the orifice 242*a* as the uphole valve element 240 is moved relative to the downhole valve element 250. As described herein, the shape and quantity of the orifice 242*a* can vary to provide desired flow and control characteristics. The uphole valve element 240 can be any suitable thickness, shape and material.

The downhole valve element 250 can be coupled to the steering assembly body 202 and therefore move independently of the uphole valve element 240. In certain embodiments, the downhole valve element 250 is a fixed manifold in the steering assembly body 202. In certain embodiments, the downhole valve element 250 can be coupled to rotate with the drill bit 114 (FIG. 1B). In the depicted example, the downhole valve element 250 includes multiple orifices 252*a* and 252*b*. In certain embodiments, the downhole valve element 250 can include a single orifice 252*a*. In certain embodiments, the downhole valve element 250 can include at least three orifices 252*a*, 252*b*, and 252*c*.

In the depicted example, each of the orifices 252*a* and 252*b* are ported or are otherwise in fluid communication with a piston bore of a respective piston 218 via a flow channel 205, wherein the respective piston 218 is coupled to a respective pad 216. Therefore, in the depicted example, as fluid flow is received by an orifice 252*a* and/or 252*b*, a respective pad 216 is actuated in response to an increased fluid pressure. As described herein, the shape of the orifice 252*a*, 252*b*, and 252*c* can vary to provide desired flow and control characteristics. The downhole valve element 250 can be any suitable thickness, shape and material.

During operation, the control valve 230 can control fluid flow therethrough by (i) rotating the uphole valve element 240 relative to the downhole valve element 250, (ii) axially translating the uphole valve element 240 relative to the downhole valve element 250, or (iii) a combination of rotation and axial translation of the uphole valve element 240 relative to the downhole valve element 250.

In certain embodiments, the uphole valve element 240 is coupled to the motor 210 and can rotate independently of the downhole valve element 250 and the steering assembly body 202. The downhole valve element 250 can be rotationally coupled to the steering assembly body 202. The uphole valve element 240 can direct drilling fluid flow 201 from the orifice 242*a* to orifices 252*a* and 252*b* of the downhole valve element 250 to actuate the pads 216.

In the depicted example, the uphole valve element 240 is shown in a maximum flow position, wherein the uphole valve element 240 is rotated to a position that aligns the orifice 242*a* with the orifice 252*a* of the downhole valve element 250. In the depicted example, the uphole valve element 240 is alignable in a maximum flow position when the orifice 242*a* is aligned with at least one of the orifices 252*a* or 252*b* of the downhole valve element 250. As shown, when the orifice 242*a* is aligned with the orifice 252*a* flow is allowed to enter the orifice 252*a*. As a result drilling fluid flow 201 can actuate a piston 218 associated with the orifice 252*a*.

Further, as the uphole valve element 240 is in the maximum flow position with respect to the orifice 252*a*, the uphole valve element 240 can seal the orifice 252*b* simultaneously. Therefore, in this example, the orifice 252*b* is sealed and the respective piston 218 is not actuated.

During operation, the uphole valve element 240 can rotate and align the orifice 242*a* with each of the orifices 252*a*, 252*b* while simultaneously sealing select orifices 252*a*, 252*b*.

In certain positions, the uphole valve element 240 can be rotated to a seal position, wherein the uphole valve element 240 is rotated to a position wherein the orifice 242*a* is not aligned with any of the orifices 252*a*, 252*b* of the downhole valve element 250. In this position, flow is not allowed to any orifice 252*a*, 252*b*.

In certain embodiments, the control valve 230 can be rotated at a constant rotational speed to provide equal fluid pressure exposure to the equidistantly oriented orifices 252*a* and 252*b*. During operation as the orifice 242*a* is aligned with the orifice 252*a* pressure experienced by the corresponding piston 218 increases over time. As the orifice 242*a* is rotated out of alignment with the orifice 252*a*, fluid pressure experienced by the piston 218 drops as fluid leaves through the fluid exhaust ports 220. Similarly, other respective pistons 218 increase and decay in pressure as the respective orifice 252*a* and 252*b* is aligned with the orifice 242*a*.

While the uphole valve element 240 can be rotated at a constant RPM via the motor 210, the controller 208 can alter the rotation of the control valve 230 to provide a desired performance or effect, such as steering the drill string in a desired direction or provide a desired stability target. In certain embodiments, the uphole valve element 240 rotation can be altered for additional objectives, such as breaking obstructions in the formation, avoiding stick-slip, or minimizing actuation of failed or faulty pads.

In certain embodiments, the rotational speed of the uphole valve element 240 can be altered to vary the duty cycle of pistons 218 and subsequently the associated pads 216. As the rotational speed of the uphole valve element 240 is increased, the orifice 242*a* can be aligned to a flow position for less time per revolution.

Angular acceleration of the uphole valve element 240 can be varied by the controller 208 to allow the orifice 242*a* to dwell in a flow position aligned with select orifices 252*a* and 252*b* to increase a select pad actuation time. Similarly, the uphole valve element 240 can accelerate past a specific select orifice 252*a*, 252*b* to minimize a pad actuation. In certain embodiments, angular acceleration of the uphole valve element 240 can be utilized to provide a linear or nonlinear response independent of the shape of the orifices 252*a* and 252*b*. Further, the orifice 242*a* can be jittered back and forth to provide a desired pressure response characteristic to actuate a desired pad with a desired movement profile.

Figure 4:
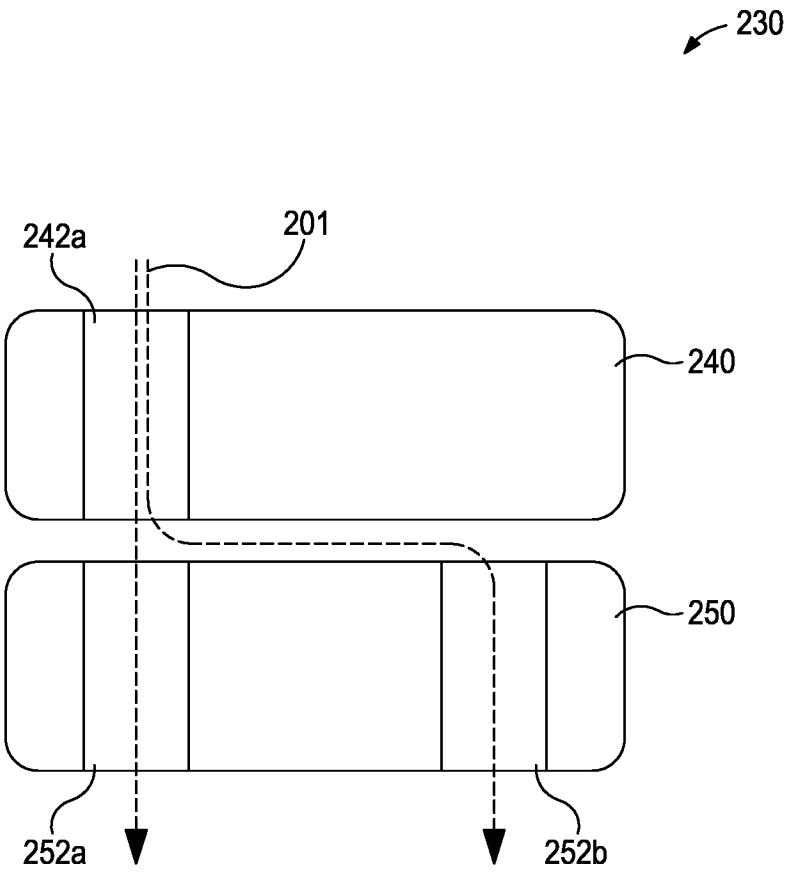
FIG. 4 is a sectional view of a control valve, according to some embodiments of the present disclosure.

FIG. 4 is a sectional view of a control valve 230 according to some embodiments of the present disclosure. In certain embodiments, the uphole valve element 240 is coupled to the standoff controller 214 and can axially translate or otherwise be spaced apart from the downhole valve element 250. The uphole valve element 240 can direct drilling fluid flow 201 from the orifice 242*a* to orifices 252*a* and 252*b* of the downhole valve element 250 to actuate the pads 216 by varying the standoff spacing between the uphole valve element 240 and the downhole valve element 250.

In the depicted example, the uphole valve element 240 is shown in a spaced apart position, wherein the uphole valve element 240 is axially translated to a position that disposes the orifice 242*a* away from the downhole valve element 250. As shown, when the uphole valve element 240 is spaced apart from the downhole valve element 250 flow from the orifice 242*a* is allowed fluid communication with the orifices 252*a*, 252*b* of the downhole valve element 250. As a result, drilling fluid flow 201 can actuate pistons 218 associated with each of the orifices 252*a*, 252*b*.

During operation, the uphole valve element 240 can be axially translated to an adjacent position, wherein the uphole valve element 240 is translated to be adjacent to or in contact with the downhole valve element 250. In the adjacent position, the rotational alignment of the orifice 242*a* and the orifices 252*a*, 252*b* controls the flow through the control valve 230, as described with respect to FIG. 3.

In certain embodiments, the standoff height between the uphole valve element 240 and the downhole valve element 250 can be varied in intermediate axial positions between a fully spaced apart position that allows equal flow between the orifice 242*a* and the orifices 252*a*, 252*b* (which may tend to provide flow to each of the orifices 252*a*, 252*b* at about the same pressure) and the adjacent position that only allows flow between the orifice 242*a* and the orifices 252*a*, 252*b* in a rotationally aligned flow position. In the intermediate axial positions, each of the orifices 252*a*, 252*b* is in fluid communication with the orifice 242*a*. In the depicted example, while each orifice 252*a*, 252*b* receives a fluid flow, the orifice 252*a* receives a greater fluid flow because the orifice 242*a* is rotationally aligned with the orifice 252*a*. In certain embodiments, the standoff height between the uphole valve element 240 and the downhole valve element 250 can be shortened to increase the flow to the orifice 252*a* relative to the orifice 252*b*, or the standoff height can be lengthened to decrease and equalize the flow to the orifice 252*a* relative to the orifice 252*b*.

In certain embodiments, the standoff height between the uphole valve element 240 and the downhole valve element 250 can be altered to allow for actuation of all of the pads 216 of the steering assembly 200. This may be performed by axially moving one or both of the disc bodies 240, 250 toward the fully spaced apart position. During operation, by actuating all of the pads 216, greater drill string stability can be provided and oscillation can be reduced. In certain embodiments, by moving the valve element's 240, 250 to a position between the fully spaced apart position on the adjacent position, a degree of pressure can be applied to the pads 216, thereby causing the pads 216 to move to a preloaded or otherwise biased configuration. In the preloaded configuration, the pads can facilitate a faster steering response because during operation, in the preloaded configuration, the pads 216 are already in contact with the wellbore wall, thus making it easier for subtle changes in pad extension to steer the drill string more quickly, thereby improving responsiveness and steering accuracy. Further, by equally actuating pads 216, cyclical wear on the pads 216 and pad seals can be reduced.

During operation, the standoff height between the uphole valve element 240 and the downhole valve element 250 can be dynamically adjusted. Further, during operation, the standoff height between the uphole valve element 240 and the downhole valve element 250 can be dynamically adjusted while the uphole valve element 240 rotates relative to the downhole valve element 250.

Figure 5:
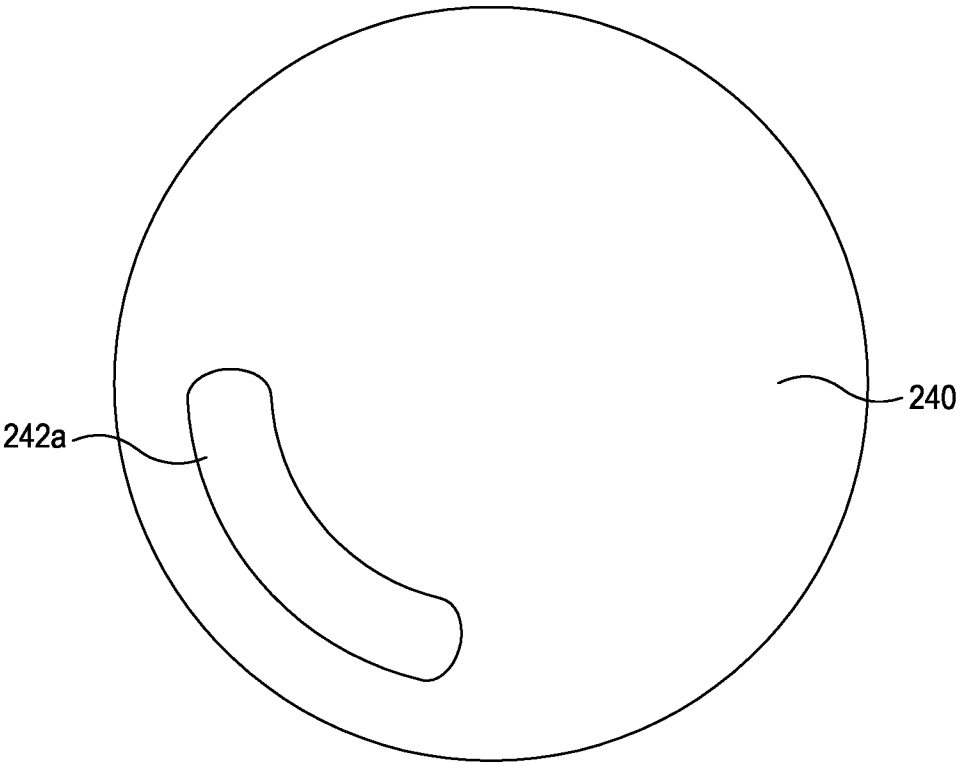
FIG. 5 is a plan view of an uphole valve element, according to some embodiments of the present disclosure.

FIG. 5 is a plan view of an uphole valve element 240 according to some embodiments of the present disclosure. The uphole valve element 240 can include an oblong upper orifice 242*a* in fluid communication with the drilling fluid flow 201, as shown in FIG. 2. The oblong slot shape of the upper orifice 242*a* allows for flow to a lower orifice 252*a*, 252*b*, 252*c* to continue for a desired duration of rotation of the uphole valve element 240. The oblong upper orifice 242*a* can be symmetrical in shape both longitudinally and latitudinally. In certain embodiments, the oblong upper orifice 242*a* can be a desired angular length to only cover a single lower orifice 252*a*, 252*b*, 252*c* at a time or multiple lower orifices 252*a*, 252*b*, 252*c*. The width of the upper orifice 242*a* can be altered to provide for a desired flow rate. The ends of the upper orifice 242*a* can be rounded or otherwise shaped as desired to provide a desired transition flow characteristic.

Figure 6:
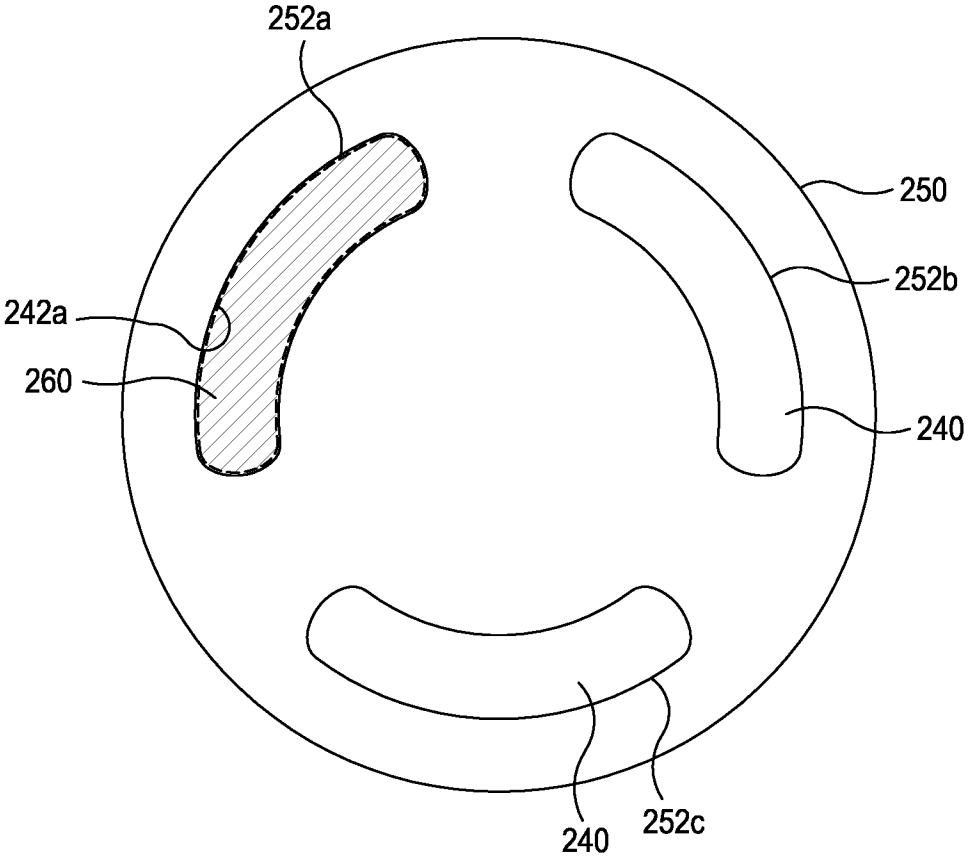
FIGS. 6-14 are plan views of various downhole valve elements in different stages of alignment with various uphole valve elements, according to some embodiments of the present disclosure.

FIG. 6 is a plan view of a downhole valve element 250 according to some embodiments of the present disclosure. The downhole valve element 250 can include multiple lower orifices 252*a*, 252*b*, and 252*c* in fluid communication with respective pads 216 via pistons 218, as shown in FIG. 2. The oblong slot shape of each of the lower orifices 252*a*, 252*b*, and 252*c* allows for flow to be received from an upper orifice 242*a* for a desired duration of rotation of the uphole valve element 240. The oblong lower orifices 252*a*, 252*b*, and 252*c* can be symmetrical in shape both longitudinally and latitudinally. The width of the lower orifices 252*a*, 252*b*, and 252*c* can be altered to provide for a desired flow rate. The ends of the upper orifice 252*a*, 252*b*, and 252*c* can be rounded or otherwise shaped as desired to provide a desired transition flow characteristic.

In the depicted example, which shows a bottom plan view of the uphole and downhole valve elements 240, 250, the shaded area 260 depicts an extent of the upper orifice 242*a*, which can overlap at least partially, depending on rotational alignment, with at least one or more of the lower orifices 252*a*, 252*b*, and 252*c* of the downhole valve element 250. In the depicted example, the upper orifice 242*a* is of a similar geometry to the lower orifice 252*a* and is rotationally aligned with the lower orifice 252*a* which would correspond to a full fluid flow being directed to the corresponding piston 218 and therefore allowing for a full actuation of the respective pad 216, shown in FIG. 2.

Figure 7:
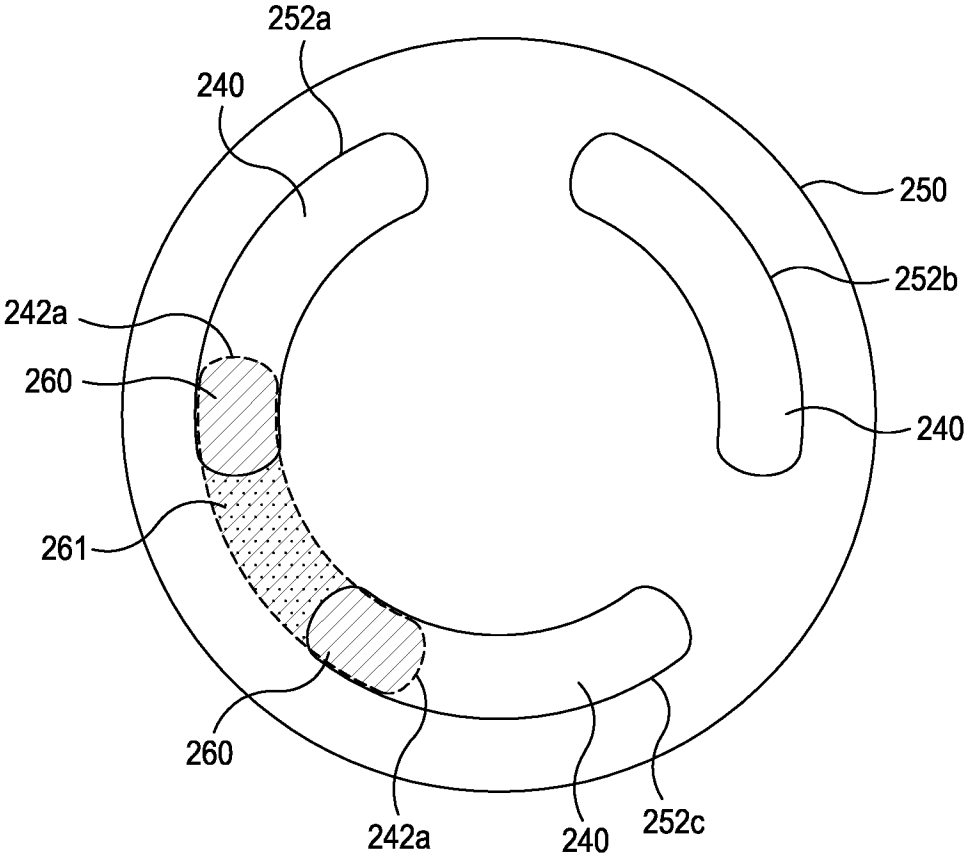

FIG. 7 is a plan view of the downhole valve element 250 of FIG. 6. In the depicted example, which shows a bottom plan view of the uphole and downhole valve elements 240, 250, the shaded area 260 depicts an extent of the upper orifice 242*a*, which can overlap evenly, depending on rotational alignment, with two or more of the lower orifices 252*a*, 252*b*, and 252*c* of the downhole valve element 250. The stippled area 261 can depict an extent of the upper orifice 242*a* overlapped by the downhole valve element 250. In the depicted example, the upper orifice 242*a* is of a similar geometry to the lower orifices 252*a*, 252*b* and is equally rotationally aligned between lower orifice 252*a* and lower orifice 252*b* which would correspond to an evenly distributed fluid flow between the lower orifice 252*a* and the lower orifice 252*b*, allowing for equal actuation of the respective pads 216, shown in FIG. 2.

Figure 8:
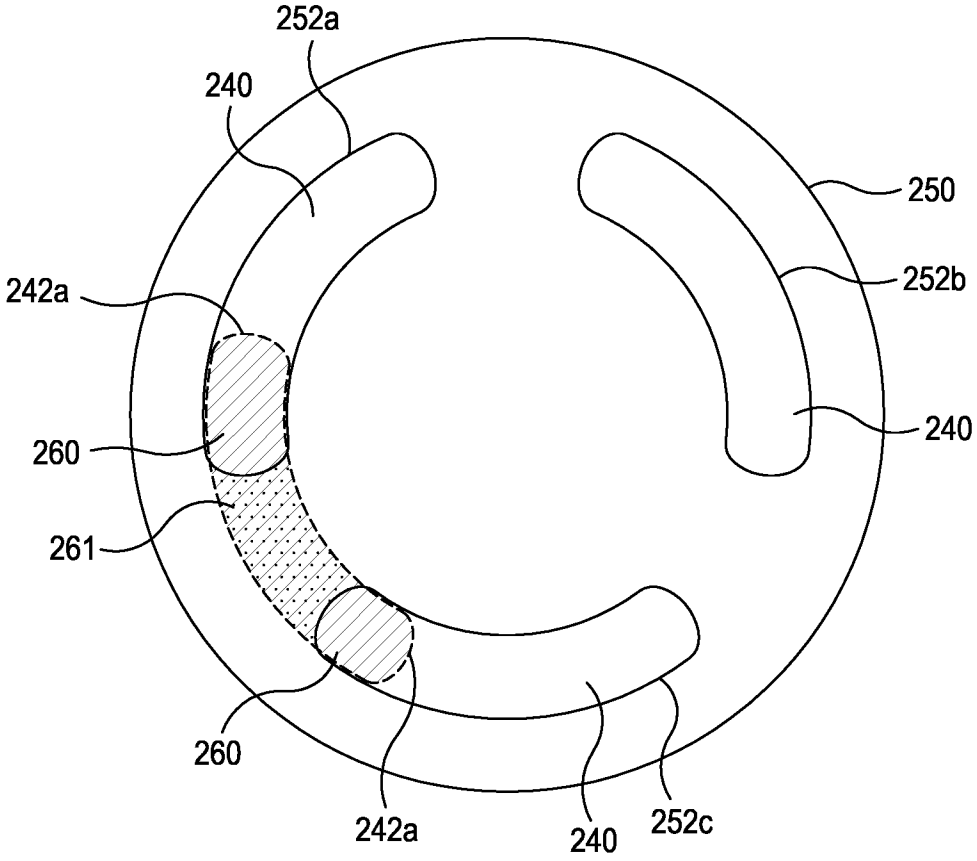

FIG. 8 is a plan view of a downhole valve element 250 of FIG. 6. In the depicted example, which shows a bottom plan view of the uphole and downhole valve elements 240, 250, the shaded area 260 depicts an extent of the upper orifice 242*a*, which can overlap unevenly, depending on rotational alignment, with two or more of the lower orifices 252*a*, 252*b*, and 252*c* of the downhole valve element 250. The stippled area 261 can depict an extent of the upper orifice 242*a* overlapped by the downhole valve element 250. In the depicted example, the upper orifice 242*a* is of a similar geometry to the lower orifice 252*a* and is unequally aligned between the lower orifices 252*a*, 252*b* and is biased to allow greater flow to the lower orifice 252*a* and less flow to the lower orifice 252*b* to allow differential actuation of the respective pads 216, shown in FIG. 2. During operation, partial flow can be provided to multiple lower orifices 252*a*, 252*b*, and 252*c* by altering the alignment of the upper orifice 242*a*. In certain embodiments, the resulting flow is proportional to the flow area provided by the upper orifice 242*a* respective to the lower orifices 252*a*, 252*b*, and 252*c*.

Figure 9:
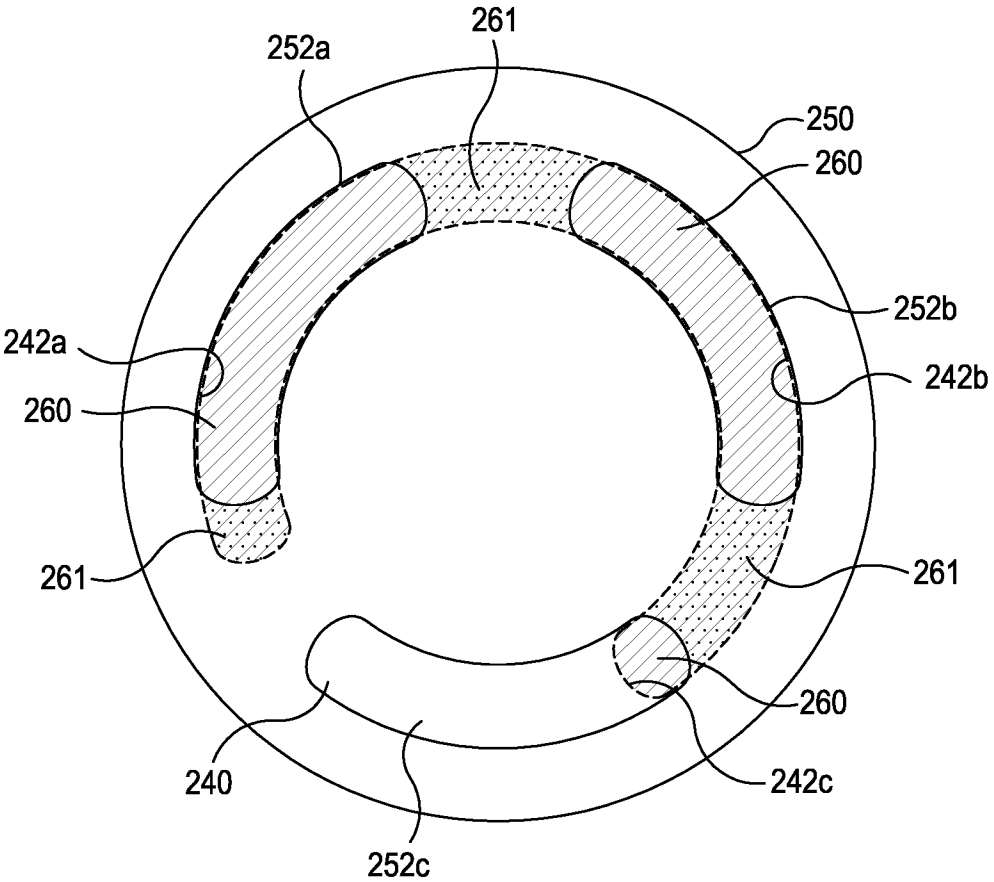

FIG. 9 is a plan view of a downhole valve element 250 of FIG. 6. In the depicted example, which shows a bottom plan view of the uphole and downhole valve elements 240, 250, the shaded area 260 depicts an extent of the upper orifice 242*a*, which can overlap, depending on rotational alignment, with at least two of the lower orifices 252*a*, 252*b*, and 252*c* of the downhole valve element 250. The stippled area 261 can depict an extent of the upper orifice 242*a* overlapped by the downhole valve element 250. In the depicted example, this can correspond to flow through all the orifices 252*a*, 252*b*, and 252*c* with greater flow to the lower orifice 252*a* and 252*b*, and less flow to the lower orifice 252*c* to allow differential actuation of the respective pads 216, shown in FIG. 2. During operation, flow can be provided to multiple lower orifices 252*a*, 252*b*, and 252*c* by altering the alignment of the upper orifice 242*a*. In certain embodiments, the resulting flow is proportional to the flow area provided by the upper orifice 242*a* respective to the lower orifices 252*a*, 252*b*, and 252*c*.

Figure 10:
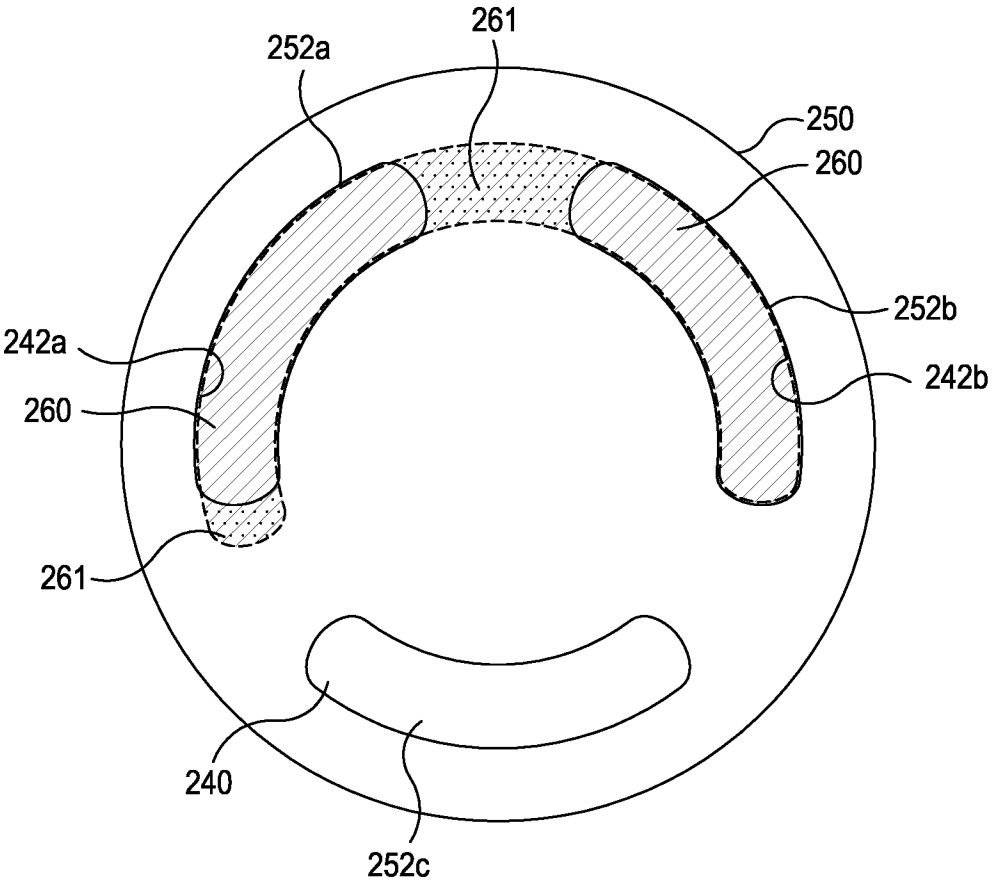

FIG. 10 is a plan view of a downhole valve element 250 of FIG. 6. In the depicted example, which shows a bottom plan view of the uphole and downhole valve elements 240, 250, the shaded area 260 depicts an extent of the upper orifice 242*a*, which can overlap, depending on rotational alignment, with two of the lower orifices 252*a*, 252*b*, and 252*c* of the downhole valve element 250 at any given rotational position. The stippled area 261 can depict an extent of the upper orifice 242*a* overlapped by the downhole valve element 250. During operation, flow can be provided to multiple lower orifices 252*a*, 252*b*, and 252*c* by altering the alignment of the upper orifice 242*a*. In certain embodiments, the resulting flow is proportional to the flow area provided by the upper orifice 242*a* respective to the lower orifices 252*a*, 252*b*, and 252*c*.

Figure 11:
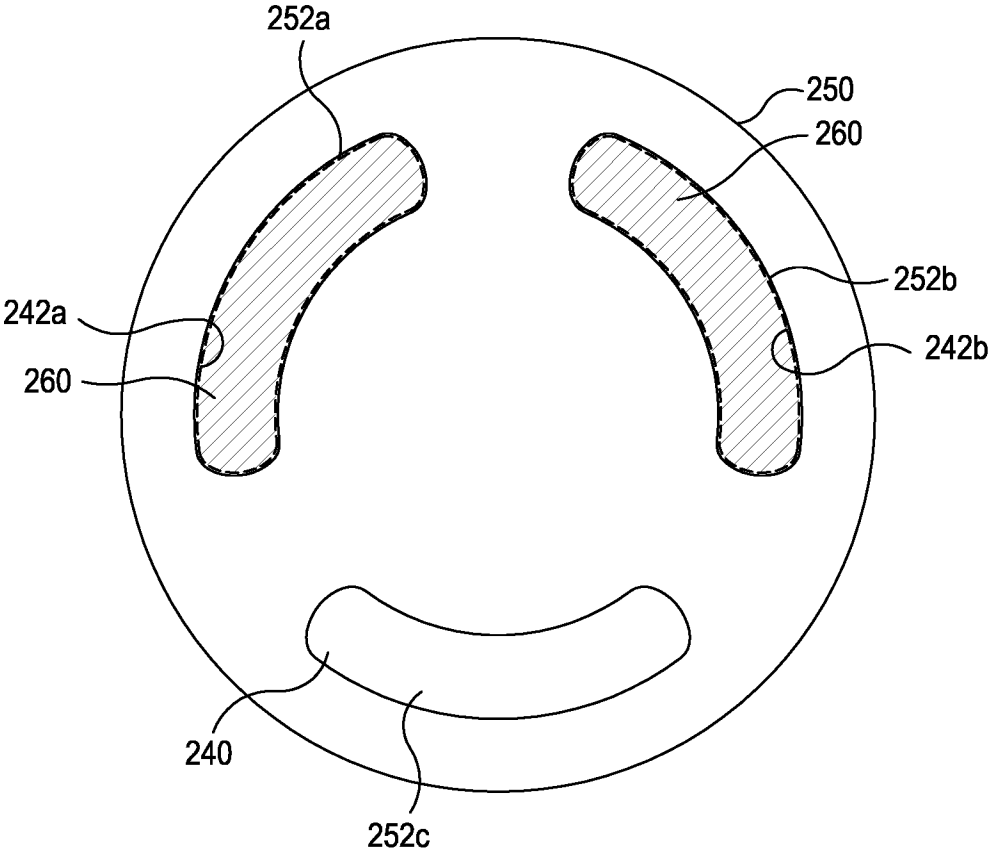

FIG. 11 is a plan view of a downhole valve element 250 of FIG. 6. In the depicted example, which shows a bottom plan view of the uphole and downhole valve elements 240, 250, the shaded area 260 depicts an extent of the upper orifices 242*a* and 242*b*, which can overlap, depending on rotational alignment, with two of the lower orifices 252*a*, 252*b*, and 252*c* of the downhole valve element 250 at any given rotational position. During operation, this can correspond to an evenly distributed fluid flow between the lower orifice 252*a* and the lower orifice 252*b*, allowing for equal actuation of the respective pads 216, shown in FIG. 2.

Figure 12:
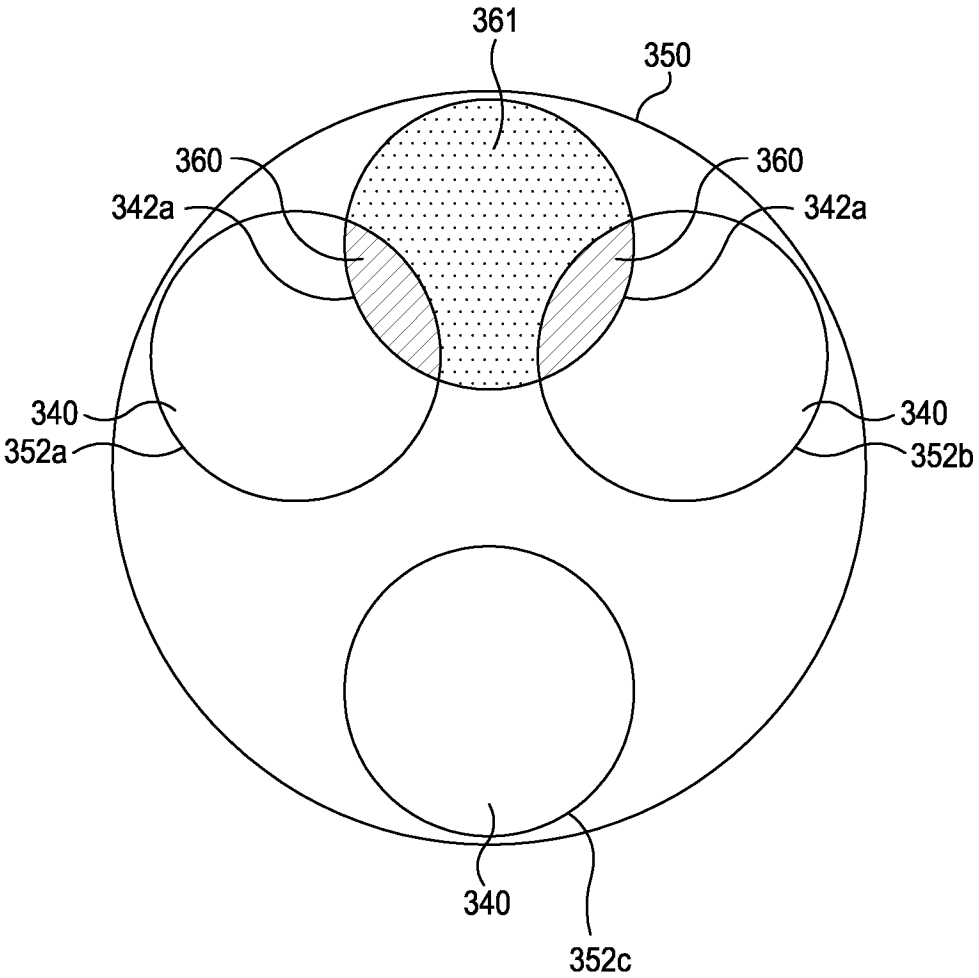

FIG. 12 is a plan view of a downhole valve element 350 according to some embodiments of the present disclosure. The downhole valve element 350 can include multiple lower orifices 352*a*, 352*b*, and 352*c* in fluid communication with respective pads 216 via pistons 218, shown in FIG. 2. The circular shape of each of the lower orifices 352*a*, 352*b*, and 352*c* allows for flow to be received from an upper orifice 342*a* for a desired duration of rotation of the uphole valve element 340. The circular lower orifices 352*a*, 352*b*, and 352*c* can be altered in size to provide for a desired flow rate.

In the depicted example, which shows a bottom plan view of the uphole and downhole valve elements 340, 350, the shaded area 360 depicts an extent of the upper orifice 342*a*, which can overlap, depending on rotational alignment, with two or more of the lower orifices 352*a*, 352*b*, and 352*c* of the downhole valve element 350. The stippled area 361 can depict an extent of the upper orifice 342*a* overlapped by the downhole valve element 350. In the depicted example, the use of circular orifices 352*a*, 352*b*, and 352*c* can provide a non-linear flow rate increase as the upper orifice 342*a* is aligned with the lower orifices 352*a*, 352*b*, and 352*c*. As illustrated, the upper orifice 360 is evenly distributed between the lower orifice 352*a* and the lower orifice 352*b*. During operation this can correspond to an evenly distributed fluid flow between the lower orifice 352*a* and the lower orifice 352*b*, allowing for equal actuation of the respective pads 216, shown in FIG. 2.

Figure 13:
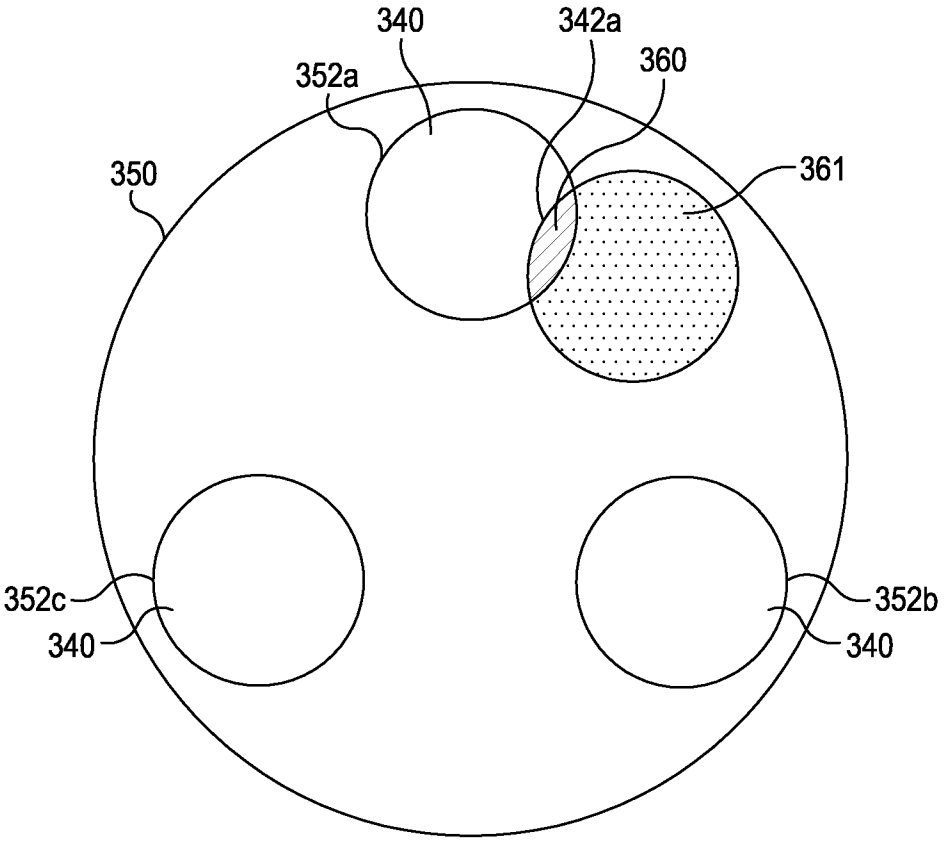

FIG. 13 is a plan view of a downhole valve element 350 of FIG. 12. In the depicted example, which shows a bottom plan view of the uphole and downhole valve elements 340, 350, the shaded area 360 depicts an extent of the upper orifice 342*a*, which can partially overlap, depending on rotational alignment, with one or more of the lower orifices 352*a*, 352*b*, and 352*c* of the downhole valve element 350. The stippled area 361 can depict an extent of the upper orifice 342*a* overlapped by the downhole valve element 350.

Figure 14:
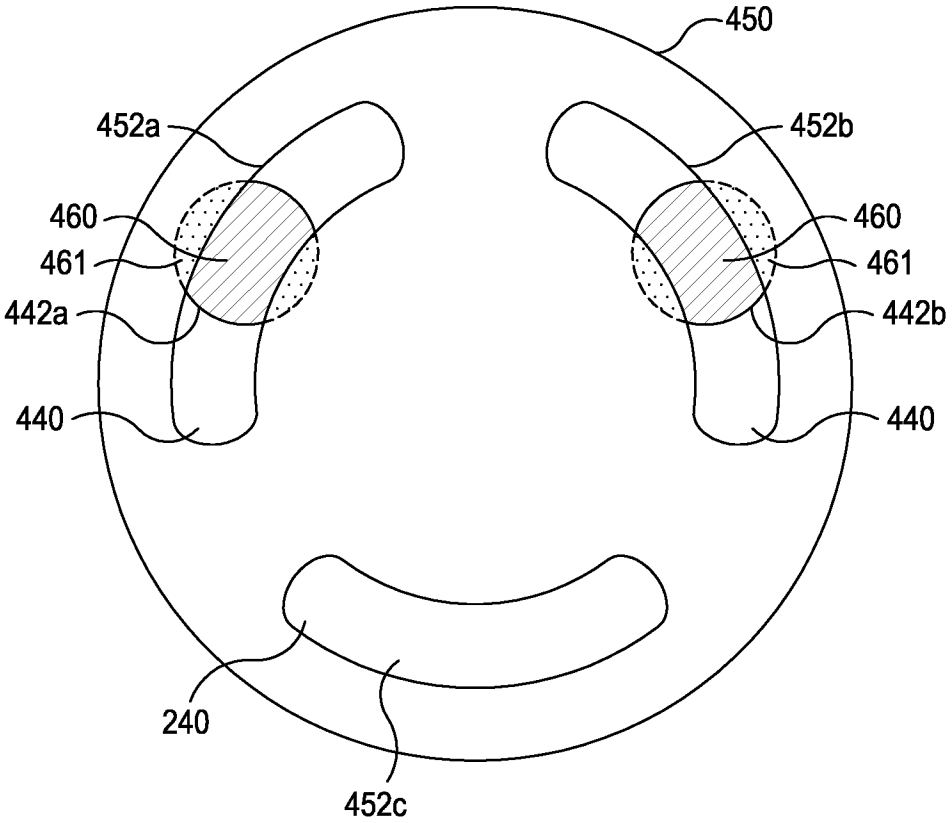

FIG. 14 is a plan view of a downhole valve element 450 according to some embodiments of the present disclosure. In the depicted example, which shows a bottom plan view of the uphole and downhole valve elements 440, 450, the shaded area 460 depicts an extent of multiple orifices 442*a* and 442*b*, which can overlap, depending on rotational alignment, with one or more of the lower orifices 452*a*, 452*b*, and 452*c* of the downhole valve element 450. The stippled area 461 can depict an extent of the upper orifices 442*a* and 442*b* overlapped by the downhole valve element 450. In the depicted example, the upper orifices 442*a* are of a circular shape and overlap with lower orifices 452*a* and 452*b* that are of oblong shape. As illustrated, the upper orifices 442*a* and 442*b* aligned over the lower orifices 452*a* and 452*b*. During operation this can correspond to an evenly distributed fluid flow between the lower orifice 452*a* and the lower orifice 452*b*, allowing for equal actuation of the respective pads 216, shown in FIG. 2.

In accordance with some embodiments, the uphole valve element can further include one or more auxiliary orifices disposed proximate to the upper orifice, which can provide desired flow characteristics for steering the drill string.

Figure 15:
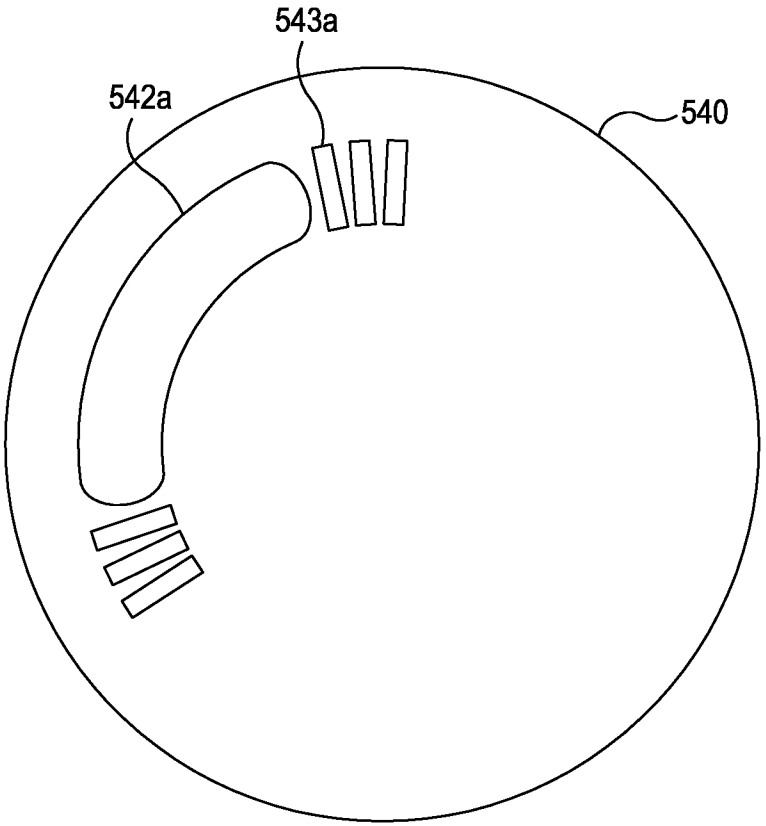
FIGS. 15 and 16 are plan views of different uphole valve elements, according to some embodiments of the present disclosure.

For example, FIG. 15 is a plan view of an uphole valve element 540 according to some embodiments of the present disclosure. The uphole valve element 540 can include an oblong upper orifice 542*a* in fluid communication with the drilling fluid flow 201, as shown in FIG. 2. The oblong slot shape of the upper orifice 542*a* allows for flow to a lower orifice 252*a*, 252*b*, 252*c* to continue for a desired duration of rotation of the uphole valve element 540. In the depicted example, the uphole valve element 540 further includes a plurality of auxiliary orifices 543*a* disposed proximate to the upper orifice 542*a*. The auxiliary orifices 543*a* can comprise rectangular slots. The auxiliary orifices 543*a* can be any suitable size and can be disposed on a similar arc as the upper orifice 542*a*. During operation, drilling fluid flow 201 can flow through the auxiliary orifices 543*a* to flow to a lower orifice 252*a*, 252*b*, 252*c* at a lower pressure or flow rate to actuate a pad 216, shown in FIG. 2, prior to, or after the primary actuation provided by the upper orifice 542*a*.

Figure 16:
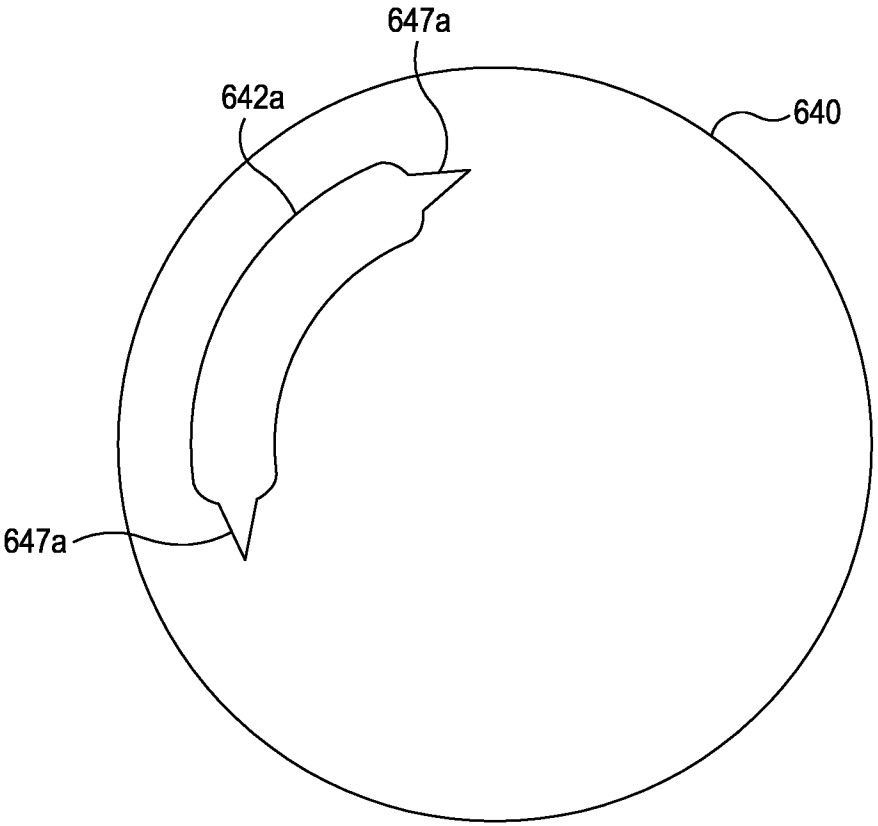

FIG. 16 is a plan view of an uphole valve element 640 according to some embodiments of the present disclosure. The uphole valve element 640 can include an oblong upper orifice 642*a* in fluid communication with the drilling fluid flow 201, as shown in FIG. 2. The oblong slot shape of the upper orifice 642*a* allows for flow to a lower orifice 252*a*, 252*b*, 252*c* to continue for a desired duration of rotation of the uphole valve element 640. In the depicted example, the ends of the upper orifice 642*a* have a tapered end geometry 641*a* to gradually increase or decrease flow to a lower orifice 252*a*, 252*b*, 252*c* to actuate a pad 216, shown in FIG. 2 prior to, or after the primary actuation provided by the upper orifice 642*a*.

Figure 17:
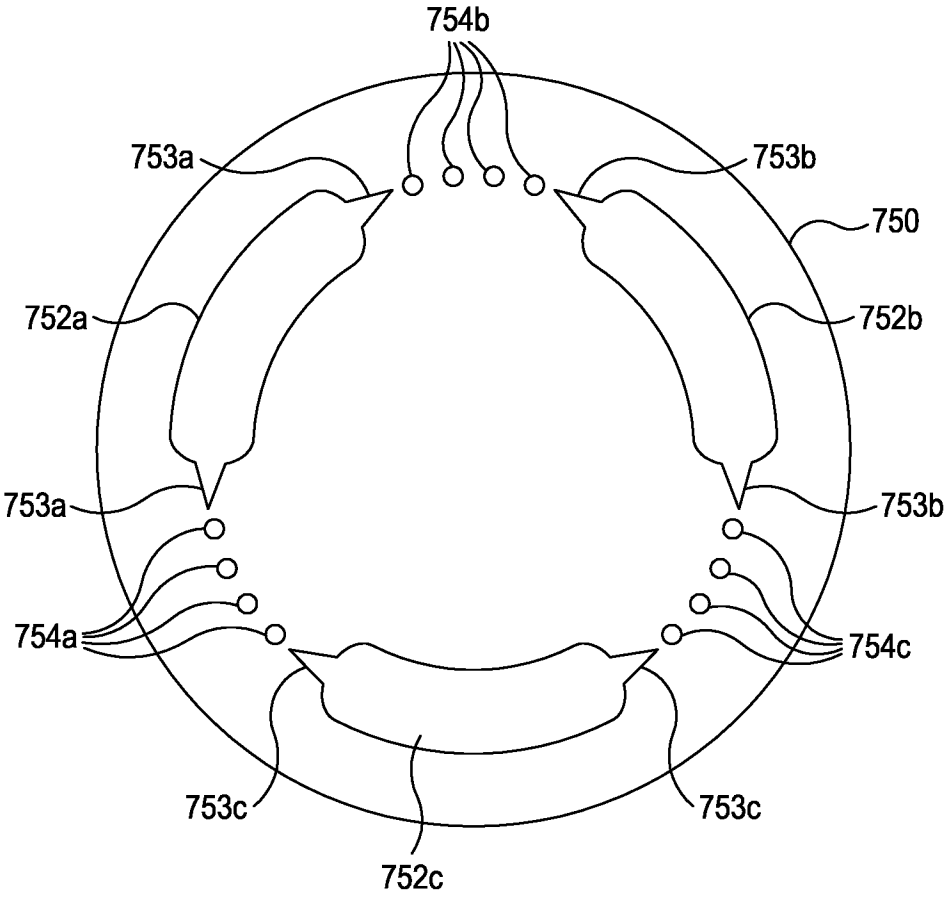
FIGS. 17 and 18 are plan views of different downhole valve elements, according to some embodiments of the present disclosure.

FIG. 17 is a plan view of a downhole valve element 750 according to some embodiments of the present disclosure. The downhole valve element 750 can include multiple lower orifices 752*a*, 752*b*, and 752*c* in fluid communication with respective pads 216 via pistons 218, shown in FIG. 2. The oblong slot shape of each of the lower orifices 752*a*, 752*b*, and 752*c* allows for flow to be received from an upper orifice 242*a* for a desired duration of rotation of the uphole valve element 240. In the depicted example, the ends of the lower orifices 752*a*, 752*b*, and 752*c* have a tapered end geometry 753*a*, 753*b*, and 753*c* to gradually increase or decrease flow to each lower orifice 752*a*, 752*b*, 752*c*.

In the depicted example, the downhole valve element 750 further includes a plurality of auxiliary orifices 754*a*, 754*b*, and 754*c* disposed proximate to the respective lower orifices 752*a*, 752*b*, and 752*c*. The auxiliary orifices 754*a*, 754*b*, and 754*c* can be circular orifices. The auxiliary orifices 754*a*, 754*b*, and 754*c* can be any suitable size and can be disposed on a similar arc as the respective lower orifices 752*a*, 752*b*, and 752*c*. The auxiliary orifices 754*a*, 754*b*, and 754*c* are each in fluid communication with the respective lower orifices 752*a*, 752*b*, and 752*c*. During operation, drilling fluid flow 201, shown in FIG. 2, can flow through the auxiliary orifices 754*a*, 754*b*, and 754*c* to flow to a lower orifice 752*a*, 752*b*, 752*c* at a lower pressure or flow rate to actuate a pad 216, shown in FIG. 2, prior to, or after the primary actuation provided by the upper orifice 242*a*.

Figure 18:
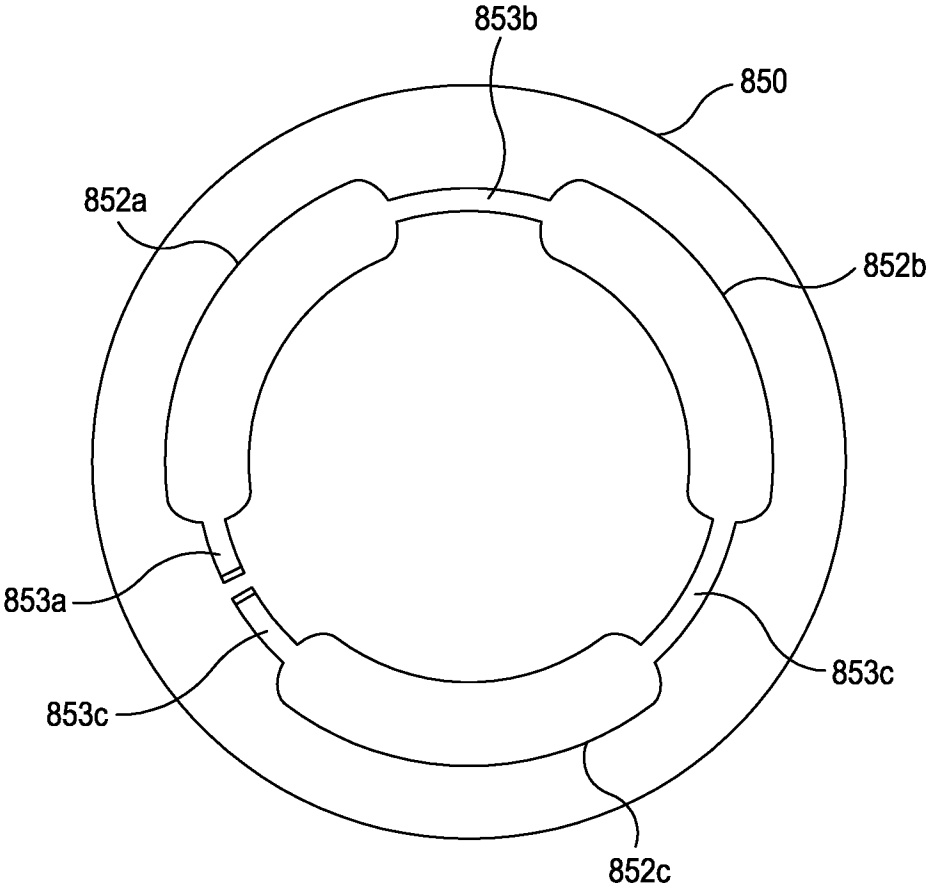

FIG. 18 is a plan view of a downhole valve element 850 according to some embodiments of the present disclosure. The downhole valve element 850 can include multiple lower orifices 852*a*, 852*b*, and 852*c* in fluid communication with respective pads 216 via pistons 218, shown in FIG. 2. In the depicted example, the lower orifice 852*a*, 852*b*, and 852*c* are placed in fluid communication with each other via end geometry 853*a*, 853*b*, and 853*c*. The end geometry 853*a*, 853*b*, and 853*c* allows at least partial fluid flow through the lower orifices 852*a*, 852*b*, and 852*c* if any of the lower orifices 852*a*, 852*b*, and 852*c* receive a fluid flow.

Figure 19:
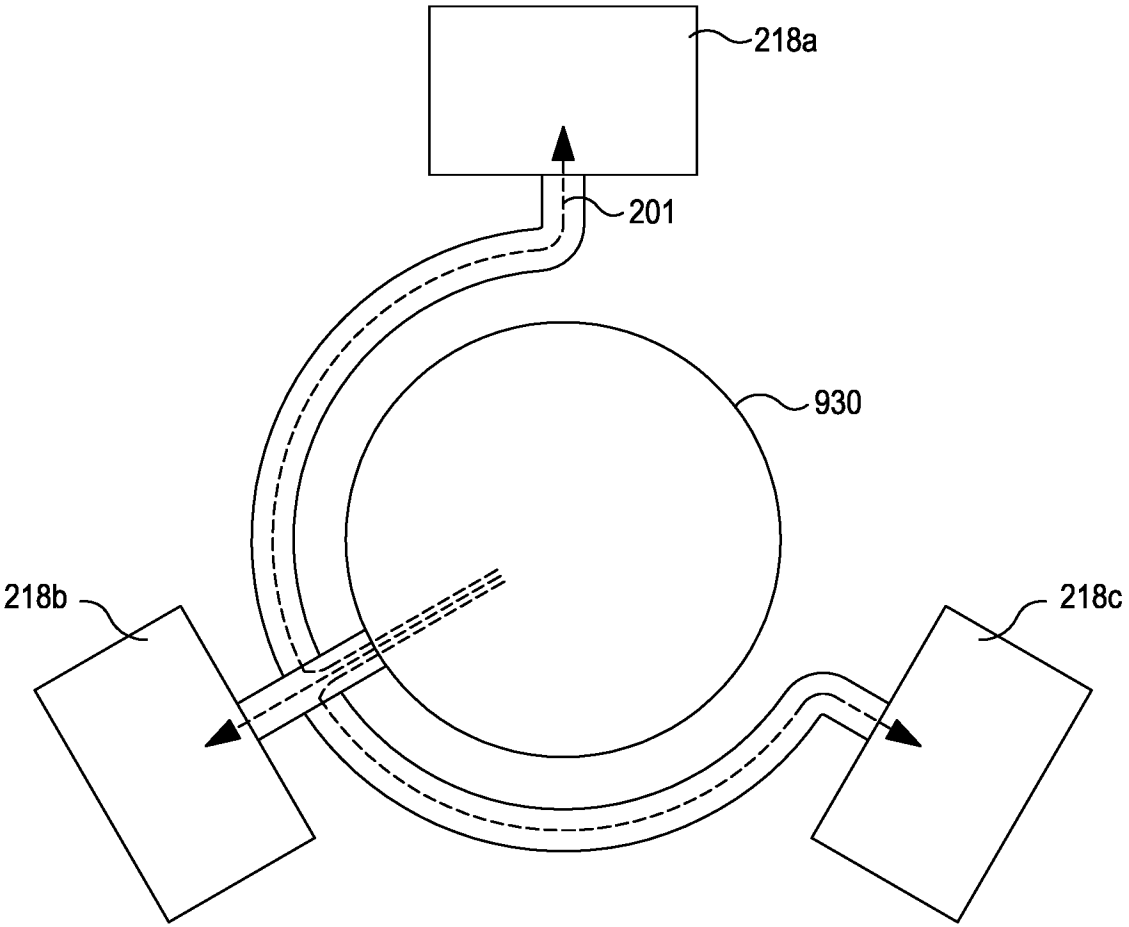
FIG. 19 is a schematic view of a control valve, according to some embodiments of the present disclosure.

FIG. 19 is a schematic view of a control valve 930 according to some embodiments of the present disclosure. In the depicted example, the control valve 930 is a barrel valve that can receive drilling fluid flow 201 and direct the drilling fluid flow 201 to at least one piston 218*a*, 218*b*, 218*c*.

In the depicted example, each of the flow ports 217*a*, 217*b*, and 217*c* is ported or is otherwise in fluid communication with the respective piston 218*a*, 218*b*, and 218*c*, wherein each respective piston 218*a*, 218*b*, and 218*c* is coupled to a pad 216, as shown in FIG. 2. Therefore, as fluid flow is received by the flow ports 217*a*, 217*b*, and 217*c*, a respective pad 216 is actuated in response to an increased fluid pressure. The multiple flow ports 217*a*, 217*b*, and 217*c* can be formed in the steering assembly body 202, as shown in FIG. 2, in a sleeve disposed around the control valve 930, or otherwise disposed around the control valve 930. In the depicted example, the multiple flow ports 217*a*, 217*b*, and 217*c* are circumferentially aligned. Further, the multiple flow ports 217*a*, 217*b*, and 217*c* can be axially spaced apart.

Figure 20:
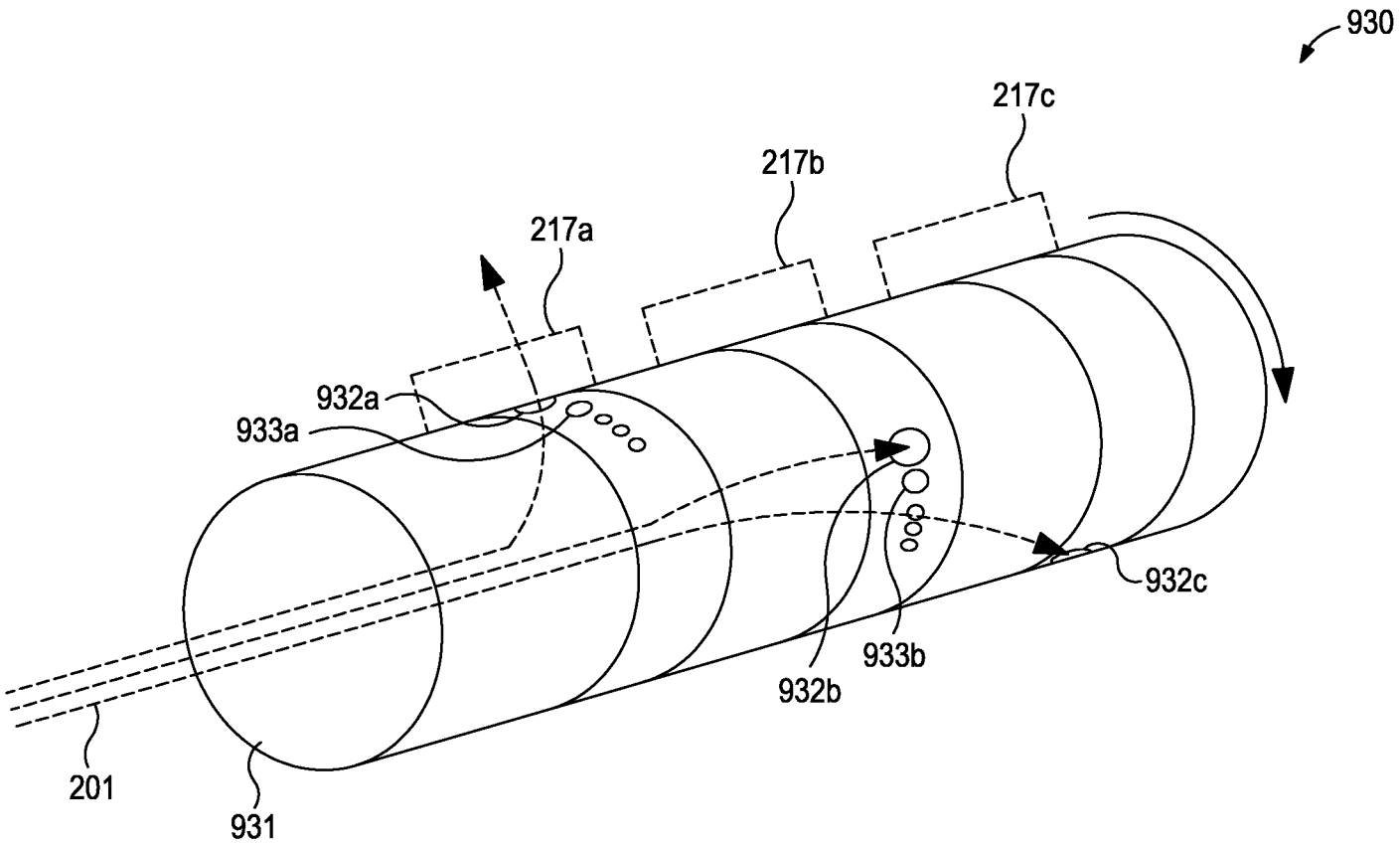
FIG. 20 is an isometric view of a control valve, according to some embodiments of the present disclosure.
Figure 21:
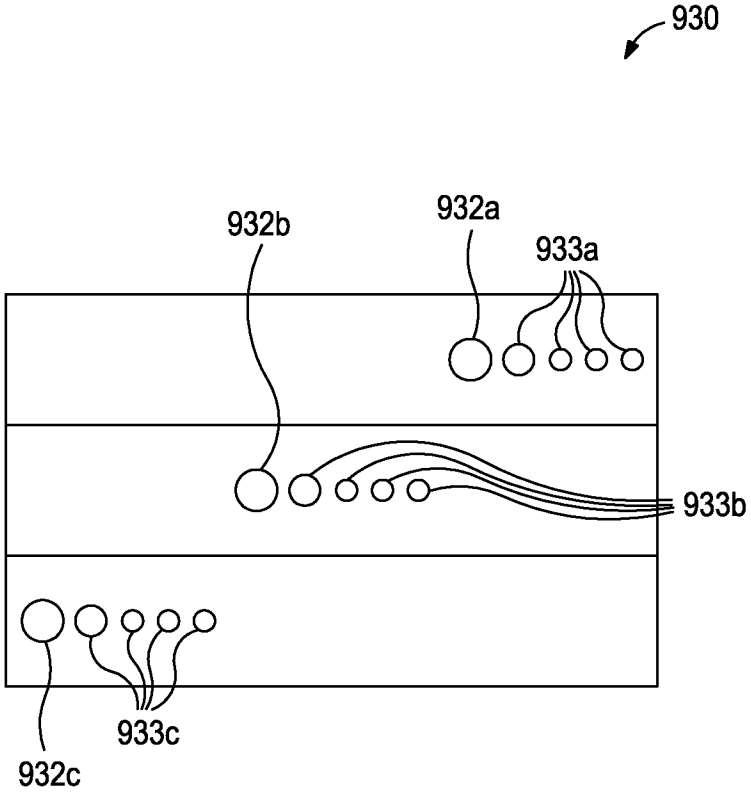
FIG. 21 is a rectangular projection view of the control valve shown in FIG. 20, according to some embodiments of the present disclosure.

FIG. 20 is an isometric view of a control valve 930 and FIG. 21 is a rectangular projection view of the control valve 930 shown in FIG. 20 according to some embodiments of the present disclosure. The control valve can be coupled to the output shaft 212 to be rotatably coupled to the motor 210, as shown in FIG. 2. In the depicted example, the control valve 930 includes a central bore 931 and orifices 932*a*, 932*b*, and 932*c*. The control valve 930 can be a cylindrical body or sleeve. Further, in certain embodiments, the control valve 930 can include auxiliary orifices 933*a*, 933*b*, and 933*c*. The central bore 931 can allow the drilling fluid flow 201 from an uphole location to pass through the orifices 932*a*, 932*b*, and 932*c*. The orifices 932*a*, 932*b*, and 932*c* can be circumferentially spaced apart. Further, auxiliary flow can be provided by the auxiliary orifices 933*a*, 933*b*, and 933*c*.

In certain embodiments, the control valve 930 is rotatably coupled to the motor 210 and can rotate independently of the steering assembly body 202, shown in FIG. 2. During operation, the control valve 930 can rotate relative to the flow ports 217*a*, 217*b*, and 217*c*. In the depicted example, the control valve 930 is shown in a maximum flow position, wherein the control valve 930 is rotated to a position that aligns the orifice 932*a* with the flow port 217*a*. In the depicted example, the control valve 930 is alignable in a maximum flow position when one of the orifices 932*a*, 932*b* or 932*c* is aligned with the respective flow ports 217*a*, 217*b*, and 217*c*. As shown, when the orifice 932*a* is aligned with the flow port 217*a*, the drilling fluid flow 201 is allowed to enter the flow port 217*a*. As a result, the drilling fluid flow 201 can actuate the piston 218*c* associated with the flow port 217*a*.

Further, as the control valve 930 is in the maximum flow position with respect to the flow port 217*a*, the control valve 930 can seal the flow ports 217*b* and 217*c* simultaneously. Therefore, in this example, the flow ports 217*b* and 217*c* are sealed and the respective pistons 218*b* and 218*c* are not actuated. During operation, the control valve 930 can rotate and align the orifices 932*a*, 932*b*, and 932*c* with each of the flow ports 217*a*, 217*b*, and 217*c* respectively while sealing the flow ports 217*a*, 217*b*, and 217*c*. The auxiliary orifices 933*a*, 933*b*, and 933*c* can provide a reduced fluid flow to the flow ports 217*a*, 217*b*, and 217*c* as the control valve 930 rotates.

In certain rotation positions, the control valve 930 can be rotated to a seal position, wherein the control valve 930 is rotated to a position wherein the orifices 932*a*, 932*b*, and 932*c* are not aligned with any of the flow ports 217*a*, 217*b*, and 217*c*. In this position, flow is not allowed to any flow port 217*a*, 217*b*, and 217*c*.

In certain embodiments, the control valve 930 can be rotated at a constant rotational speed to provide equal fluid pressure exposure to the flow ports 217*a*, 217*b*, and 217*c*. During operation as the orifice 932*a* is aligned with the flow port 217*a* pressure experienced by the corresponding piston 218*a* increases over time. As the orifice 932*a* is rotated out of alignment with the flow port 217*a*, fluid pressure experienced by the piston 218*a* drops, as fluid leaves through the fluid exhaust ports 220, as shown in FIG. 2. Similarly, other respective pistons 218*b* and 218*c* increase and decay in pressure as the respective orifices 932*b*, and 932*c* are aligned with flow ports 217*b* and 217*c*.

While the control valve 930 can be rotated at a constant RPM via the motor 210, the controller 208, shown in FIG. 2 can alter the rotation of the control valve 930 to provide a desired performance or effect, such as steering the drill string in a desired direction or provide a desired stability target. In certain embodiments, the control valve 930 rotation can be altered for additional objectives, such as breaking obstructions in the formation, avoiding stick-slip, or minimizing actuation of failed or faulty pads.

In certain embodiments, the rotational speed of the control valve 930 can be altered to vary the duty cycle of pistons 218*a*, 218*b*, and 218*c* and subsequently the associated pads 216, shown in FIG. 2. As the rotational speed of the control valve 930 is altered, the orifices 932*a*, 932*b*, and 932*c* can be aligned to a flow position for less time per revolution.

Angular acceleration of the control valve 930 can be varied by the controller 208, shown in FIG. 2 to allow the orifices 932*a*, 932*b*, and 932*c* to dwell in a flow position aligned with select flow ports 217*a*, 217*b*, and 217*c* to increase a select pad actuation time. Similarly, the control valve 930 can accelerate past a specific select flow port 217*a*, 217*b*, and 217*c* to minimize a pad actuation. In certain embodiments, angular acceleration of the control valve 930 can be utilized to provide a linear or nonlinear response independent of the layout of the orifices 932*a*, 932*b* and 932*c*. Further, the orifices 932*a*, 932*b* and 932*c* can be jittered back and forth to provide a desired pressure response characteristic to actuate a desired pad with a desired movement profile.

Figure 22:
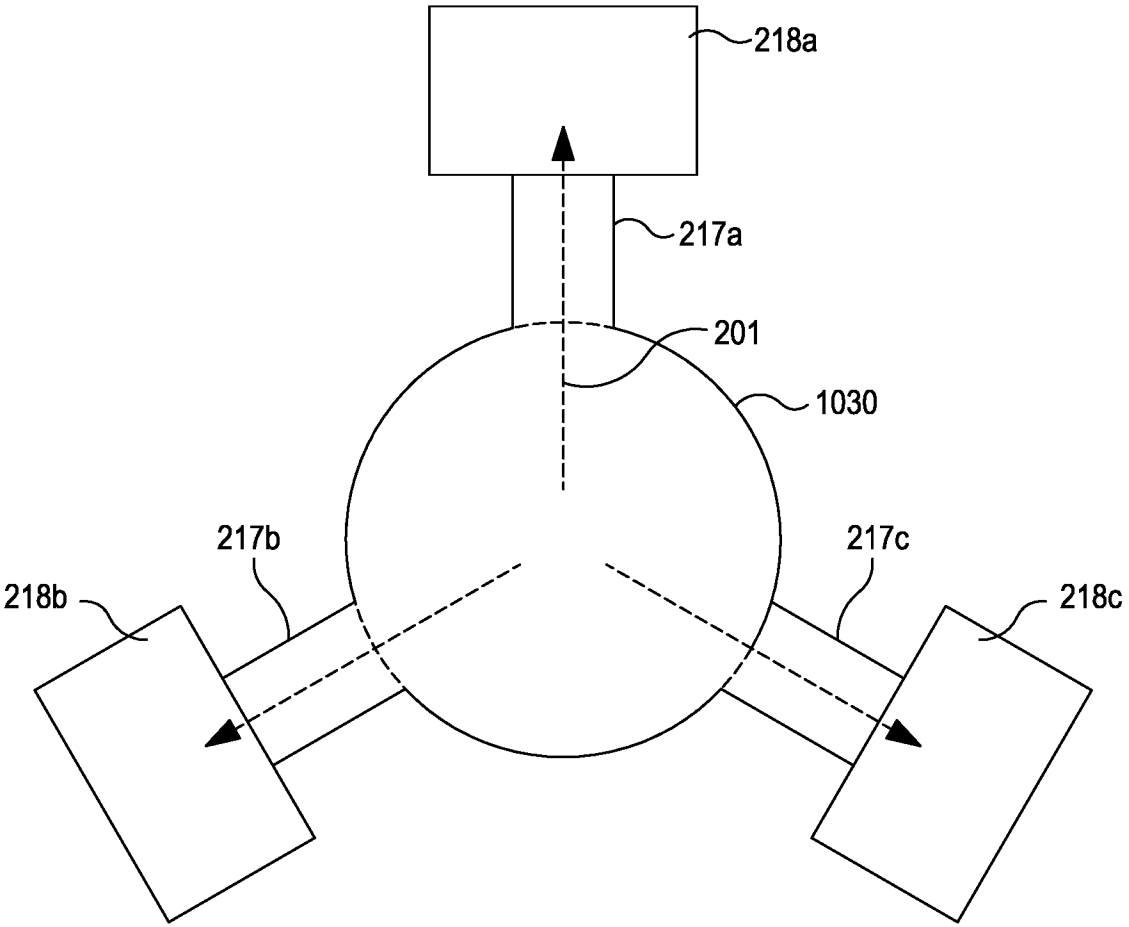
FIG. 22 is a schematic view of a control valve, according to some embodiments of the present disclosure.

FIG. 22 is a schematic view of a control valve 1030 according to some embodiments of the present disclosure. In the depicted example, the control valve 1030 is a barrel valve that can receive drilling fluid flow 201 and direct the drilling fluid flow 201 to at least one piston 218*a*, 218*b*, 218*c*.

In the depicted example, each of the flow ports 217*a*, 217*b*, and 217*c* is ported or is otherwise in fluid communication with the respective piston 218*a*, 218*b*, and 218*c*, wherein each respective piston 218*a*, 218*b*, and 218*c* is coupled to a pad 216, shown in FIG. 2. Therefore, as fluid flow is received by the flow ports 217*a*, 217*b*, and 217*c*, a respective pad 216 is actuated in response to an increased fluid pressure. The multiple flow ports 217*a*, 217*b*, and 217*c* can be formed in the steering assembly body 202, as shown in FIG. 2, in a sleeve disposed around the control valve 1030, or otherwise disposed around the control valve 1030. In the depicted example, the multiple flow ports 217*a*, 217*b*, and 217*c* are equidistantly disposed along a circumference. The multiple flow ports 217*a*, 217*b*, and 217*c* can be spaced apart on an arc approximately 120 degrees apart. Further, the multiple flow ports 217*a*, 217*b*, and 217*c* can be axially spaced apart.

Figure 23:
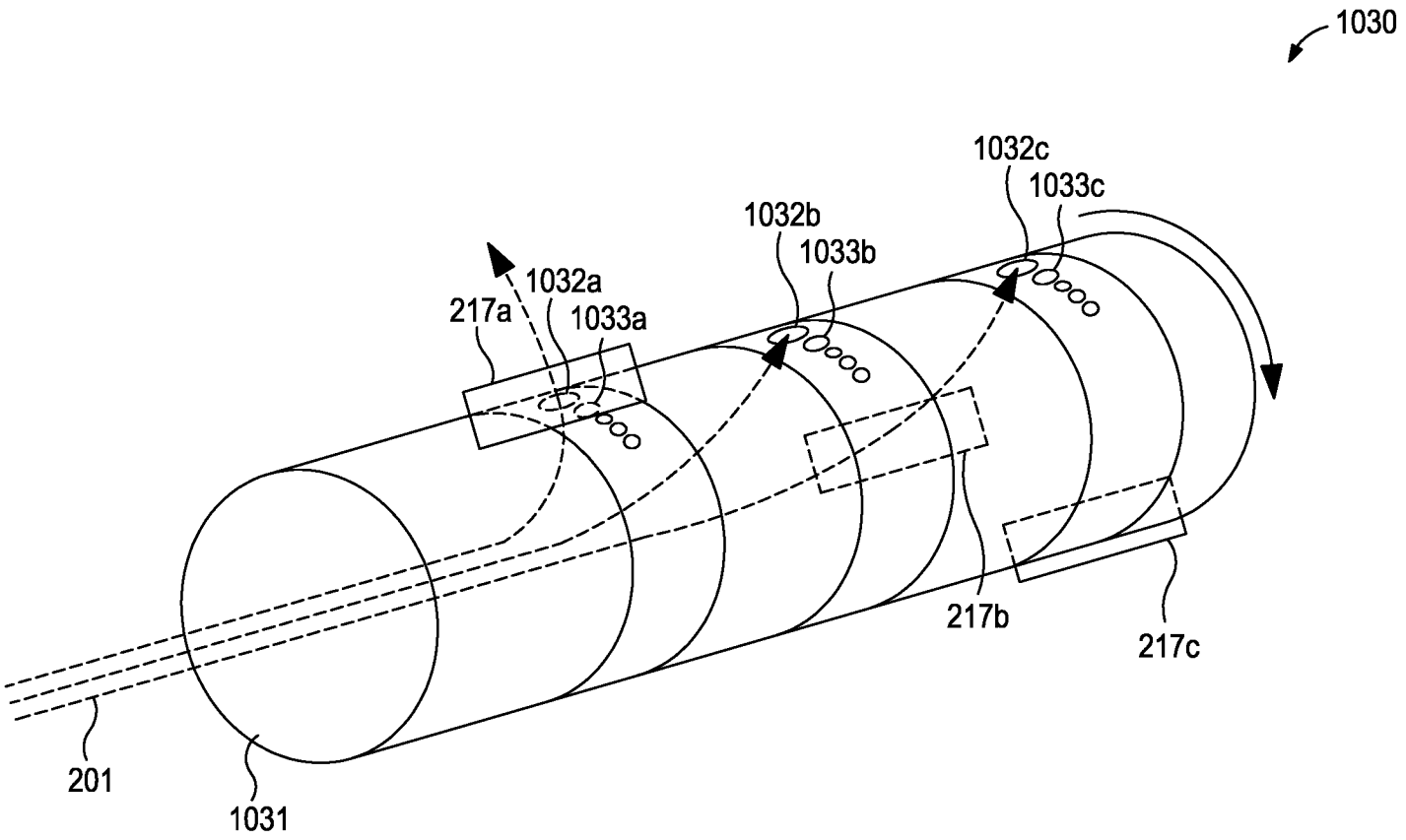
FIG. 23 is an isometric view of a control valve, according to some embodiments of the present disclosure.
Figure 24:
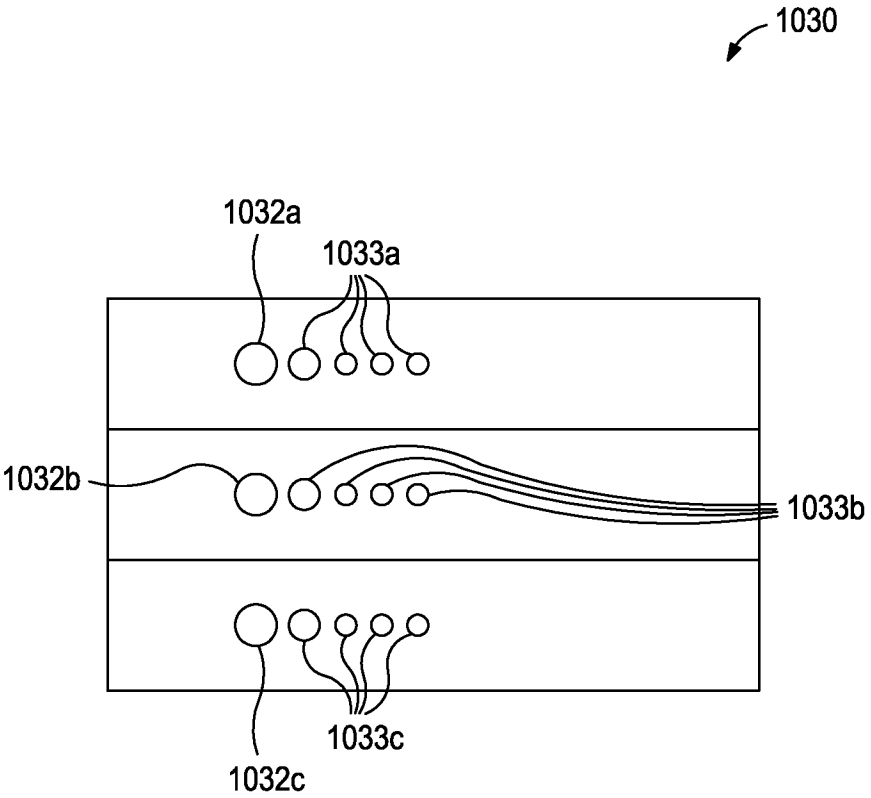
FIG. 24 is a rectangular projection view of the control valve shown in FIG. 23, according to some embodiments of the present disclosure.

FIG. 23 is an isometric view of a control valve 1030 and FIG. 24 is a rectangular projection view of the control valve 1030 shown in FIG. 22 according to some embodiments of the present disclosure. The control valve can be coupled to the output shaft 212 to be rotatably coupled to the motor 210, shown in FIG. 2. In the depicted example, the control valve 1030 includes a central bore 1031 and orifices 1032*a*, 1032*b*, and 1032*c*. The control valve 1030 can be a cylindrical body or sleeve. Further, in certain embodiments, the control valve 1030 can include auxiliary orifices 1033*a*, 1033*b*, and 1033*c*. The central bore 1031 can allow the drilling fluid flow 201 from an uphole location to pass through the orifices 1032*a*, 1032*b*, and 1032*c*. The orifices 1032*a*, 1032*b*, and 1032*c* can be circumferentially aligned. Further, auxiliary flow can be provided by the auxiliary orifices 1033*a*, 1033*b*, and 1033*c*.

Various examples of aspects of the disclosure are described below as clauses for convenience. These are provided as examples, and do not limit the subject technology.

Clause 1. A control valve for a steering assembly of a drill string, the control valve comprising: a first valve element including an orifice, the first valve element being movable by actuation by an electric motor; and a second valve element including an orifice, wherein flow passing through the first valve element orifice passes through the second orifice and into a flow channel to be in fluid communication with a piston bore to exert pressure against a piston movable within the piston bore, the piston being coupled a steering pad for applying force against the wellbore wall to steer a direction of the drill string, wherein the first valve element is movable with respect to the second valve element to change flow through the first valve element orifice and the second valve element orifice to modify fluid pressure within the flow channel that is exerted against the piston, the first and second valve elements being movable relative to each other to increase or decrease flow toward the piston for controlling actuation of the piston.

Clause 2. The control valve of Clause 1, wherein the first valve element rotates with respect to the second valve element.

Clause 3. The control valve of any preceding clause, wherein the first valve element axially translates with respect to the second valve element.

Clause 4. The control valve of any preceding clause, wherein the second orifice is rotatably alignable with the first orifice in the maximum flow position to provide the maximum flow toward the piston.

Clause 5. The control valve of any preceding clause, wherein the maximum flow position includes a plurality of maximum flow positions.

Clause 6. The control valve of any preceding clause, wherein the first valve element includes a first disk.

Clause 7. The control valve of Clause 6, wherein the first disk is disposed uphole with respect to the second valve element when coupled with the drill string.

Clause 8. The control valve of any preceding clause, wherein the second valve element includes a second disk.

Clause 9. The control valve of Clause 8, wherein the second disk is disposed downhole with respect to the first valve element when coupled with the drill string.

Clause 10. The control valve of any preceding clause, wherein the second valve element includes a cylindrical sleeve having a central bore.

Clause 11. The control valve of Clause 10, wherein the first valve element is disposed in the central bore of the cylindrical sleeve.

Clause 12. The control valve of any preceding clause, wherein the first valve element includes a cylindrical valve element.

Clause 13. The control valve of Clause 12, wherein the cylindrical valve element is disposed within the second valve element.

Clause 14. The control valve of any preceding clause, wherein the first orifice includes a plurality of first orifices.

Clause 15. The control valve of any preceding clause, wherein the first orifice includes one first orifice.

Clause 16. The control valve of any preceding clause, wherein the second orifice includes a plurality of second orifices.

Clause 17. The control valve of Clause 16, wherein the first orifice is movable with respect to the plurality of second orifices to a multiple flow position to provide flow to the plurality of second orifices.

Clause 18. The control valve of Clause 17, wherein the multiple flow position provides an equal flow to each of the plurality of second orifices.

Clause 19. The control valve of any preceding clause, wherein the second orifice includes two second orifices.

Clause 20. The control valve of any preceding clause, wherein the second orifice includes three second orifices.

Clause 21. The control valve of any preceding clause, wherein the first orifice includes an oblong first orifice.

Clause 22. The control valve of any preceding clause, wherein the second orifice includes an oblong second orifice.

Clause 23. The control valve of any preceding clause, wherein the first orifice includes a circular first orifice.

Clause 24. The control valve of any preceding clause, wherein the second orifice includes a circular second orifice.

Clause 25. The control valve of any preceding clause, wherein the first orifice includes a circular first orifice and the second orifice includes an oblong second orifice.

Clause 26. The control valve of any preceding clause, wherein the first orifice includes a plurality of slots.

Clause 27. The control valve of any preceding clause, wherein the second orifice includes a plurality of slots.

Clause 28. The control valve of any preceding clause, wherein the second valve element includes an auxiliary orifice in fluid communication with the piston, the auxiliary orifice disposed circumferentially adjacent to the second orifice.

Clause 29. A control valve, comprising: a first valve element including a first orifice; and a second valve element including a second orifice, wherein the first valve element rotates relative to the second valve element to provide selective fluid communication between the first orifice and the second orifice.

Clause 30. A control valve, comprising: a first valve element including a first orifice; and a second valve element including a second orifice, wherein the first valve element rotates relative to the second valve element to align the first orifice with the second orifice.

Clause 31. A rotary steering device, comprising: a device valve element; a plurality of pads associated with an outer surface of the device valve element; a plurality of pistons operatively coupled to the plurality of pads to actuate the plurality of pads; and a control valve disposed within the device valve element, the control valve including: a first valve element including an orifice, the first valve element being movable by actuation by an electric motor; and a second valve element including an orifice, wherein flow passing through the first valve element orifice passes through the second orifice and into a flow channel to be in fluid communication with a piston bore to exert pressure against a piston of the plurality of pistons movable within the piston bore, the piston being coupled a steering pad for applying force against the wellbore wall to steer a direction of the drill string, wherein the first valve element is movable with respect to the second valve element to change flow through the first valve element orifice and the second valve element orifice to modify fluid pressure within the flow channel that is exerted against the piston, the first and second valve elements being movable relative to each other to increase or decrease flow toward the piston for controlling actuation of the piston.

Clause 32. The rotary steering device of Clause 31, further including an output shaft coupling the electric motor to the first valve element.

Clause 33. The rotary steering device of any Clause 31 or 32, wherein the first valve element rotates with respect to the second valve element.

Clause 34. The rotary steering device of any Clause 31-33, wherein the first valve element axially translates with respect to the second valve element.

Clause 35. The rotary steering device of Clause 34, further including a standoff controller operatively coupled to the first valve element to axially translate the first valve element relative to the second valve element.

Clause 36. The rotary steering device of any Clause 31-35, wherein the second orifice is alignable with the first orifice in the maximum flow position to provide the maximum flow toward the piston.

Clause 37. The rotary steering device of any Clause 31-36, wherein the maximum flow position includes a plurality of maximum flow positions.

Clause 38. The rotary steering device of any Clause 31-37, wherein the first valve element includes a first disk when coupled with the drill string.

Clause 39. The rotary steering device of Clause 38 wherein the first disk is disposed uphole with respect to the second valve element when coupled with the drill string.

Clause 40. The rotary steering device of any Clause 31-39, wherein the second valve element includes a second disk.

Clause 41. The rotary steering device of Clause 40, wherein the second disk is disposed downhole with respect to the first valve element.

Clause 42. The rotary steering device of any Clause 31-41, wherein the second valve element includes a cylindrical sleeve having a central bore.

Clause 43. The rotary steering device of any Clause 31-42, wherein the first valve element is disposed in the central bore of the cylindrical sleeve.

Clause 44. The rotary steering device of any Clause 31-43, wherein the first valve element includes a cylindrical valve element.

Clause 45. The rotary steering device of Clause 44, wherein the cylindrical valve element is disposed within the second valve element.

Clause 46. The rotary steering device of any Clause 31-45, wherein the first orifice includes a plurality of first orifices.

Clause 47. The rotary steering device of any Clause 31-46, wherein the first orifice includes one first orifice.

Clause 48. The rotary steering device of any Clause 31-47, wherein the second orifice includes a plurality of second orifices.

Clause 49. The rotary steering device of Clause 48, wherein the first orifice is movable with respect to the plurality of second orifices to a multiple flow position to provide flow to the plurality of second orifices.

Clause 50. The rotary steering device of Clause 49, wherein the multiple flow position provides an equal flow to each of the plurality of second orifices.

Clause 51. The rotary steering device of any Clause 31-50, wherein the second orifice includes two second orifices.

Clause 52. The rotary steering device of any Clause 31-51, wherein the second orifice includes three second orifices.

Clause 53. The rotary steering device of any Clause 31-52, wherein the first orifice includes an oblong first orifice.

Clause 54. The rotary steering device of any Clause 31-53, wherein the second orifice includes an oblong second orifice.

Clause 55. The rotary steering device of any Clause 31-54, wherein the first orifice includes a circular first orifice.

Clause 56. The rotary steering device of any Clause 31-55 wherein the second orifice includes a circular second orifice.

Clause 57. The rotary steering device of any Clause 31-56, wherein the first orifice includes a circular first orifice and the second orifice includes an oblong second orifice.

Clause 58. The rotary steering device of any Clause 31-57, wherein the first orifice includes a plurality of slots.

Clause 59. The rotary steering device of any Clause 31-58, wherein the second orifice includes a plurality of slots.

Clause 60. The rotary steering device of any Clause 31-59, wherein the second valve element includes an auxiliary orifice in fluid communication with the piston, the auxiliary orifice disposed circumferentially adjacent to the second orifice.

Clause 61. A method of steering a drill string, comprising: drilling into a subterranean formation using a drill bit operatively coupled to a rotary steering device, the rotary steering device including a first valve element and a second valve element movable relative to each other to modify fluid pressure through the rotary steering device toward a piston for urging a pad to apply force to the wellbore wall; and moving the first valve element with respect to the second valve element to change flow through a first valve element orifice and a second valve element orifice to modify fluid pressure within a flow channel that is exerted against the piston.

Clause 62. The method of Clause 61, wherein the moving includes rotating the first valve element with respect to the second valve element.

Clause 63. The method of Clause 62, wherein the first valve element rotates at a first rotational rate relative to the second valve element.

Clause 64. The method of Clause 63, wherein the first valve element accelerates to the first rotational rate at a first acceleration rate.

Clause 65. The method of any Clause 61-64, wherein the moving includes axially translating the first valve element with respect to the second valve element.

Clause 66. The method of Clause 65, wherein the moving includes axially translating the first valve element relative to the second valve element via a standoff controller operatively coupled to the first valve element.

Clause 67. The method of Clause 65, wherein the moving includes rotating the first valve element with respect to the second valve element.

Clause 68. The method of any Clause 61-67, wherein the second orifice includes a plurality of second orifices.

Clause 69. The method of Clause 68, wherein the moving includes moving the first orifice with respect to the plurality of second orifices to a multiple flow position to provide flow to the plurality of second orifices.

Clause 70. The method of Clause 69, wherein the multiple flow position provides an equal flow to each of the plurality of second orifices.

Clause 71. The method of any Clause 61-70, further including altering an azimuthal tool face orientation of the drill bit.

What is claimed is:

1. A control valve for a steering assembly of a drill string, the control valve comprising:

a first valve element including an orifice, the first valve element being movable by actuation by a motor;

a second valve element including an orifice, wherein flow passing through the first valve element orifice passes through the second orifice and into a flow channel to be in fluid communication with a piston bore to exert pressure against a piston movable within the piston bore, the piston being coupled to a steering pad for applying force against the wellbore wall to steer a direction of the drill string; and a standoff controller operable to rotate the first valve element at a constant rotational speed via the motor, the standoff controller disposed between the motor and the first valve element, wherein the first valve element is movable with respect to the second valve element to change flow through the first valve element orifice and the second valve element orifice to modify fluid pressure within the flow channel that is exerted against the piston, the first and second valve elements being movable relative to each other to increase or decrease flow toward the piston for controlling actuation of the piston.

2. The control valve of claim 1, wherein the first valve element rotates with respect to the second valve element.

3. The control valve of claim 1, wherein the first valve element axially translates with respect to the second valve element.

4. The control valve of claim 1, wherein the second orifice is rotatably alignable with the first orifice in a maximum flow position to provide a maximum flow toward the piston.

5. The control valve of claim 1, wherein the first valve element includes a first disk.

6. The control valve of claim 1, wherein the second valve element includes a second disk.

7. The control valve of claim 1, wherein the second valve element includes a cylindrical sleeve having a central bore.

8. The control valve of claim 1, wherein the second orifice includes a plurality of second orifices.

9. The control valve of claim 8, wherein the first orifice is movable with respect to the plurality of second orifices to a multiple flow position to provide flow to the plurality of second orifices.

10. The control valve of claim 1, wherein the first orifice includes an oblong first orifice.

11. The control valve of claim 1, wherein the second orifice includes an oblong second orifice.

12. The control valve of claim 1, wherein the first orifice includes a circular first orifice.

13. The control valve of claim 1, wherein the second orifice includes a circular second orifice.

14. The control valve of claim 1, wherein the first orifice includes a circular first orifice and the second orifice includes an oblong second orifice.

15. The control valve of claim 1, wherein the second orifice includes a plurality of slots.

16. A rotary steering device, comprising:

a device body;

a plurality of pads associated with an outer surface of the device body;

a plurality of pistons operatively coupled to the plurality of pads to actuate the plurality of pads; and a control valve disposed within the device body, the control valve including:

a first valve element including an orifice, the first valve element being movable by actuation by a motor; and a second valve element including an orifice, wherein flow passing through the first valve element orifice passes through the second orifice and into a flow channel to be in fluid communication with a piston bore to exert pressure against a piston of the plurality of pistons movable within the piston bore, the piston being coupled to a steering pad for applying force against the wellbore wall to steer a direction of the drill string; and a standoff controller operable to rotate the first valve element at a constant rotational speed via the motor, the standoff controller disposed between the motor and the first valve element, wherein the first valve element is movable with respect to the second valve element to change flow through the first valve element orifice and the second valve element orifice to modify fluid pressure within the flow channel that is exerted against the piston, the first and second valve elements being movable relative to each other to increase or decrease flow toward the piston for controlling actuation of the piston.

17. The rotary steering device of claim 16, wherein the first valve element axially translates with respect to the second valve element.

18. The rotary steering device of claim 17, further including a standoff controller operatively coupled to the first valve element to axially translate the first valve element relative to the second valve element.

19. A method of controlling force applied to a well bore wall, comprising:

drilling into a subterranean formation using a drill bit operatively coupled to a rotary steering device, the rotary steering device including a first valve element and a second valve element movable relative to each other to modify fluid pressure through the rotary steering device toward a piston for urging a pad to apply force to the wellbore wall;

moving the first valve element with respect to the second valve element to change flow through a first valve element orifice and a second valve element orifice to modify fluid pressure within a flow channel that is exerted against the piston; and rotating the first valve element at a constant rotational speed via a motor and a standoff controller, the standoff controller disposed between the motor and the first valve element.

20. The method of claim 19, further including altering an azimuthal tool face orientation of the drill bit.

* * * * *